US010913567B2

(12) United States Patent
Nelson

(10) Patent No.: US 10,913,567 B2
(45) Date of Patent: Feb. 9, 2021

(54) SHIPPING INSERT AND BLANK FOR FORMING SAME

(71) Applicant: INTERNATIONAL PAPER COMPANY, Memphis, TN (US)

(72) Inventor: Kent Owen Nelson, Lees Summit, MO (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 370 days.

(21) Appl. No.: 16/037,143

(22) Filed: Jul. 17, 2018

(65) Prior Publication Data

US 2020/0024027 A1 Jan. 23, 2020

(51) Int. Cl.
*B65D 5/42* (2006.01)
*B65D 5/355* (2006.01)
(Continued)

(52) U.S. Cl.
CPC ..... *B65D 5/422* (2013.01); *B65D 5/002* (2013.01); *B65D 5/0005* (2013.01); *B65D 5/009* (2013.01);
(Continued)

(58) Field of Classification Search
CPC ..... B65D 5/002; B65D 5/005; B65D 5/009; B65D 5/02; B65D 5/0245; B65D 5/08;
(Continued)

(56) References Cited

U.S. PATENT DOCUMENTS 1,898,646 A 2/1933 Taylor
2,074,315 A 3/1937 Neely
(Continued)

FOREIGN PATENT DOCUMENTS

DE 29720278 U1 1/1998
DE 202015007172 U1 11/2015
(Continued)

OTHER PUBLICATIONS

Custom Shipping Inserts (PSI Group); 1-, 2-, and 3-bottle shippers; http://www.psimd.com/wine-packaging/stock-wine-packaging/specialty-insterts/.
(Continued)

*Primary Examiner* — Steven A. Reynolds
*Assistant Examiner* — Javier A Pagan
(74) *Attorney, Agent, or Firm* — Michael D. Folkerts; Thomas W. Ryan

(57) ABSTRACT

An insert formed from a one-piece blank of sheet material. The insert comprises a first half comprising a first plurality of connected panels; a second half connected to the first half and comprising a corresponding, second plurality of connected panels; a first and second end comprising lateral extensions extending from respective first and second opposing ends of two panels from each of the first and second plurality of panels; and a plurality of popout tabs extending outward from an outer surface of the insert. The first and second half define respective first and second internal receiving areas each surrounded on all sides and on opposing ends by (i) two layers of the sheet material and/or (ii) an air gap defined between the outer surface of the insert and an adjacent portion of an overwrap material. A one-piece blank of sheet material for forming a shipping insert is also provided.

18 Claims, 10 Drawing Sheets

(51) Int. Cl.
*B65D 5/00* (2006.01)
*B65D 81/02* (2006.01)
*B65D 5/20* (2006.01)
*B65D 5/44* (2006.01)

(52) U.S. Cl.
CPC ..... *B65D 5/20* (2013.01); *B65D 5/44* (2013.01); *B65D 81/027* (2013.01)

(58) Field of Classification Search
CPC ..... B65D 5/10; B65D 5/106; B65D 5/103; B65D 5/422; B65D 5/48; B65D 5/4801; B65D 5/48014; B65D 5/48018; B65D 5/50; B65D 5/5007; B65D 5/5009; B65D 5/5011; B65D 5/5021; B65D 81/05; B65D 81/107; B65D 81/027; B65D 85/30; B65D 85/302; B65D 85/305; B65D 85/42
See application file for complete search history.

(56) References Cited

U.S. PATENT DOCUMENTS 2,188,732 A 1/1940 Vogt
2,299,812 A 10/1942 Ferguson
2,314,951 A 3/1943 Ringler
2,377,604 A 6/1945 Belden
2,421,748 A 6/1947 Fink
2,507,080 A 5/1950 Acker et al.
2,692,077 A * 10/1954 Kuhlman ..... B65D 5/5007 206/521
2,749,019 A 6/1956 Ohlund
2,854,181 A 9/1958 Smith
2,965,279 A 12/1960 Campbell
3,055,569 A 9/1962 Layne, Sr.
3,075,683 A 1/1963 Grossman et al.
3,240,417 A 3/1966 Andreini
3,351,261 A 11/1967 Persson
3,670,949 A 6/1972 Galanes
3,937,328 A 2/1976 Gordon
D242,845 S 12/1976 Booth
D244,584 S 6/1977 Booth
4,094,455 A 6/1978 Bamburg et al.
4,101,048 A 7/1978 Rieben
4,294,397 A 10/1981 Kohler
D262,945 S 2/1982 Lytra
4,450,965 A 5/1984 Paillet
4,770,339 A 9/1988 Weimer
4,883,221 A 11/1989 Brundage
4,911,355 A 3/1990 Bannister
4,921,099 A 5/1990 Trauschke
5,000,376 A * 3/1991 Wojdyla ..... B65D 5/505 206/593
5,335,846 A 8/1994 Smith et al.
5,361,975 A 11/1994 Droste
D380,613 S 7/1997 Apps
5,730,289 A 3/1998 Cappels
D415,680 S 10/1999 Sheffer
5,967,320 A * 10/1999 Cappels ..... B65D 5/4804 206/434
6,227,441 B1 5/2001 Sagel et al.
6,247,593 B1 6/2001 Ruble
6,296,178 B1 10/2001 McKenna, Sr.
6,474,473 B2 11/2002 Wong
6,666,333 B2 12/2003 Auclair
6,877,606 B2 4/2005 Hardy
D526,897 S 8/2006 Keberlein
7,207,473 B2 4/2007 Fry
D552,988 S 10/2007 Kisch
D608,634 S 1/2010 Riedi
D652,295 S 1/2012 Hipperson
D655,601 S 3/2012 Daley
D656,394 S 3/2012 Smith
D662,350 S 6/2012 Lee
8,205,787 B2 6/2012 Panduro, Jr.
8,230,997 B1 7/2012 McWilliams et al.
8,523,048 B1 9/2013 Spiegelman
D694,106 S 11/2013 Fitzwater
D695,635 S 12/2013 Tokoi
D719,442 S 12/2014 Lucht
D727,142 S 4/2015 Bankowski
D736,619 S 8/2015 Parkes
D738,157 S 9/2015 Krumm
D747,193 S 1/2016 Melistas
D749,944 S 2/2016 Kummerfeldt
D797,554 S 9/2017 Bankowski
9,896,234 B2 2/2018 Martinez
D812,467 S 3/2018 Lee
D812,468 S 3/2018 Carman
D813,547 S 3/2018 Wright
D813,548 S 3/2018 Wright
D814,927 S 4/2018 Campagnolo
D819,441 S 6/2018 Doster
D823,109 S 7/2018 Bankowski
D825,329 S 8/2018 Ross
D833,862 S 11/2018 Nelson
D836,914 S 1/2019 Reinhart
D842,098 S 3/2019 Ross
D856,146 S 8/2019 McKenzie
D860,778 S 9/2019 Dwork
D874,267 S 2/2020 Perella
D877,614 S 3/2020 Sollie
2009/0272789 A1 11/2009 Fry
2010/0133330 A1 6/2010 Spivey, Sr.
2011/0281705 A1 11/2011 Aganovic
2013/0153648 A1 6/2013 Smith
2017/0001793 A1 1/2017 Jiang et al.
2017/0190461 A1 7/2017 Spivey, Sr.
2017/0210504 A1 7/2017 Aguirre
2018/0009564 A1 1/2018 Carman
2018/0201402 A1 7/2018 Nelson
2018/0346178 A1 12/2018 Vasbinder
2019/0031390 A1* 1/2019 Hessburg ..... B65D 5/6664
2019/0256243 A1* 8/2019 Boersma ..... B65D 5/5076

FOREIGN PATENT DOCUMENTS

EP 0861789 A2 9/1998
EP 1505002 A1 2/2005
EP 1505002 A1 * 2/2005 ..... B65D 5/0245
EP 1574441 A1 9/2005
EP 2583906 A1 * 4/2013 ..... B65D 81/05
EP 2583906 A1 4/2013
EP 2949588 A1 5/2014
EP 2848546 A2 * 3/2015 ..... B65D 5/5059
EP 3070016 A1 * 3/2015 ..... B65D 5/02
EP 2949588 A1 * 12/2015 ..... B65D 5/5045
EP 2848546 B1 12/2016
EP 3210901 A1 * 8/2017 ..... B65D 5/5045
EP 3210901 A1 8/2017
EP 3070016 B1 1/2018
EP 3056444 B1 3/2018
ES 2472700 T3 7/2014
ES 1156358 5/2016
FR 1042137 A 10/1953
FR 1204221 A 1/1960
FR 2562872 A1 10/1985
FR 2758530 B1 2/2001
FR 2812858 2/2002
FR 2816916 A1 5/2002
FR 2847228 B1 5/2004
FR 2856041 12/2004
FR 2949758 A1 3/2011
FR 2949758 B1 7/2013
FR 2984852 B1 1/2015
FR 3043987 A1 12/2017
GB 365078 1/1932
GB 883238 A 11/1961
GB 2116904 A 10/1983
GB 2375756 A 11/2002

(56) References Cited

FOREIGN PATENT DOCUMENTS

| | | | |
|---|---|---|---|
| WO | 01/02258 | A1 | 1/2001 |
| WO | 02/087980 | A1 | 11/2002 |

OTHER PUBLICATIONS

MailSafe Postal Pack (WBC), Individual bottle shipper; https://www.wbc.co.uk/products/mailsafe-transit-boxes-for-bottles-wine.
SafePost Pack (Bectech); Individual bottle shipper; http://www.bectechpackaging.co.uk/wine-and-bottle-boxes-50-c.asp.
TotalWinePack DUO (Font Packaging); 1- and 2-bottle shippers; https://fontpackaging.com/productos/totalwinepack-duo/.

* cited by examiner

SHIPPING INSERT AND BLANK FOR FORMING SAME

FIELD OF THE INVENTION

This invention relates generally to containers for shipping products to points of sale. More particularly, the invention is an insert that may be placed in a carton for shipping.

BACKGROUND OF THE INVENTION

Products such as wine bottles and other fragile items are traditionally shipped in corrugated cardboard containers or in inserts that are molded or formed to a specific shape. Conventional cardboard shipping boxes are often bulky and provide limited impact protection. Shaped or molded inserts such as Styrofoam, plastic, or molded fiber may provide better protection but may be more expensive and are difficult to recycle.

SUMMARY OF THE INVENTION

In accordance with an aspect of the invention, an insert formed from a one-piece blank of sheet material is provided. The insert comprises a first half comprising a first plurality of panels connected in series at respective fold lines; a second half connected to the first half and comprising a corresponding, second plurality of panels connected in series at respective fold lines; a first end comprising lateral extensions extending from first opposing ends of two panels from each of the first and second plurality of panels; a second end comprising lateral extensions extending from second opposing ends of the two panels from each of the first and second plurality of panels; and a plurality of popout tabs extending outward from an outer surface of the insert. The first half of the insert defines a first internal receiving area, and the second half defines a second internal receiving area. The first and second internal receiving areas are each surrounded on all sides and on opposing ends by at least one of (i) two layers of the sheet material, or (ii) an air gap defined between the outer surface of the insert and an adjacent portion of an overwrap material by the popout tabs or the lateral extensions forming the first and second ends.

The first and second ends may each further comprise a plurality of inner end flaps, a corresponding plurality of outer end flaps, and a plurality of locking panels, in which each locking panel, when in a locked position, extends over one inner end flap and one corresponding outer end flap. Each of the inner and outer end flaps may comprise a cutout extending inward from an outer edge of the respective end flap.

The first and second half of the insert may each comprise a respective first end portion, each of which is defined on a first side by one of the locking panels and on a second and third side by the lateral extensions extending from the first opposing ends of the two panels from either the first or the second plurality of panels, in which a fourth side of each first end portion comprises an open area and each locking panel forms an entirety of the respective first side that is located opposite the open area. Each locking panel may extend toward the respective open area when in the locked position.

The first and second half of the insert may each comprise a respective second end portion opposite the respective first end portions, each of which is defined on a first side by one of the locking panels and on a second and third side by the lateral extensions extending from the second opposing ends of the two panels from either the first or the second plurality of panels, in which a fourth side of each second end portion comprises an open area and each locking panel of the second end portions forms an entirety of the respective first side that is located opposite the open area. Each locking panel in the second end portions may extend toward the respective open area when in the locked position.

The opposing ends of the first internal receiving area may be defined by one of the first end portions and one of the second end portions, and the opposing ends of the second internal receiving area may be defined by the other of the first end portions and the other of second end portions.

The first plurality of panels may comprise a first, second, third, and fourth panel; the second plurality of panels may comprise a fifth, sixth, seventh, and eighth panel; and the insert may further comprise a base panel connected to the first panel along a first side at a first fold line and to the fifth panel along a second side at a second fold line.

The plurality of inner end flaps may comprise a first pair of inner end flaps foldably joined to laterally opposed ends of the fourth panel and a second pair of inner end flaps foldably joined to laterally opposed ends of the eighth panel; the plurality of outer end flaps may comprise first and second pairs of outer end flaps foldably joined to laterally opposed ends of the base panel; the first end may comprise one end flap from each of the first and second pairs of inner and outer end flaps; and the second end may comprise the other end flap from each of the first and second pairs of inner and outer end flaps.

The first end may comprise two first end portions, one of which comprises one end flap from each of the first pair of inner and outer end flaps and the other of which comprises one end flap from each of the second pair of inner and outer end flaps, in which each of the first end portions comprises one of the plurality of locking panels. The second end may comprise two second end portions, one of which comprises the other end flap from each of the first pair of inner and outer end flaps and the other of which comprises the other end flap from each of the second pair of inner and outer end flaps, in which each of the second end portions comprises one of the plurality of locking panels.

When the first and second end portions are closed, each outer end flap may be folded over the respective inner end flap, and the locking panel may be in the locked position extending over the respective outer and inner end flaps.

The second and sixth panels together may form a first face of the insert; the base panel and the fourth and eighth panels together may form a second face of the insert, with the base panel being parallel to the fourth and eighth panels; the first panel may form a third face of the insert; and the fifth panel may form a fourth face of the insert.

The insert may be configured to be nested with a second insert that is rotated 180°, with the first face of the insert being in a facing relationship with a corresponding first face of the second insert when nested with the second insert.

The first face of the insert may comprise at least one slot and a portion of the plurality of popout tabs, in which the popout tabs extend outward from the first face of the insert; and the corresponding first face of the second insert may comprise at least one corresponding slot to receive the plurality of popout tabs extending outward from the first face of the insert and a corresponding plurality of popout tabs that are received in the at least one slot.

The first, third, and fourth faces of the insert may each comprise a plurality of popout tabs extending outward therefrom.

In accordance with another aspect of the invention, a one-piece blank of sheet material for forming a shipping insert is provided. The blank comprises a first section comprising first, second, third, and fourth panels connected in series at respective fold lines, in which first and second opposing outer ends of the first and third panels each comprise lateral extensions; a second section comprising fifth, sixth, seventh, and eighth panels connected in series at respective fold lines, in which first and second opposing outer ends of the fifth and seventh panels each comprise lateral extensions; a base panel connected to the first panel along a first side at a first fold line and to the fifth panel along a second side at a second fold line; and a plurality of locking panels defined in a lateral direction between an elongated slot and a respective lateral edge of the one-piece blank. The locking panels and corresponding elongated slots extend in a longitudinal direction between the lateral extensions on the first or the second opposing ends of the first and third panels or the fifth and seventh panels.

The fourth panel may comprise a pair of end flaps foldably joined to laterally opposed ends thereof the eighth panel may comprise a pair of end flaps foldably joined to laterally opposed ends thereof and the base panel may comprise a first and a second pair of end flaps foldably joined to laterally opposed ends thereof.

The first, third, fourth, fifth, seventh, eighth, and base panels may each comprise at least one popout tab extending outward therefrom in the longitudinal direction.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
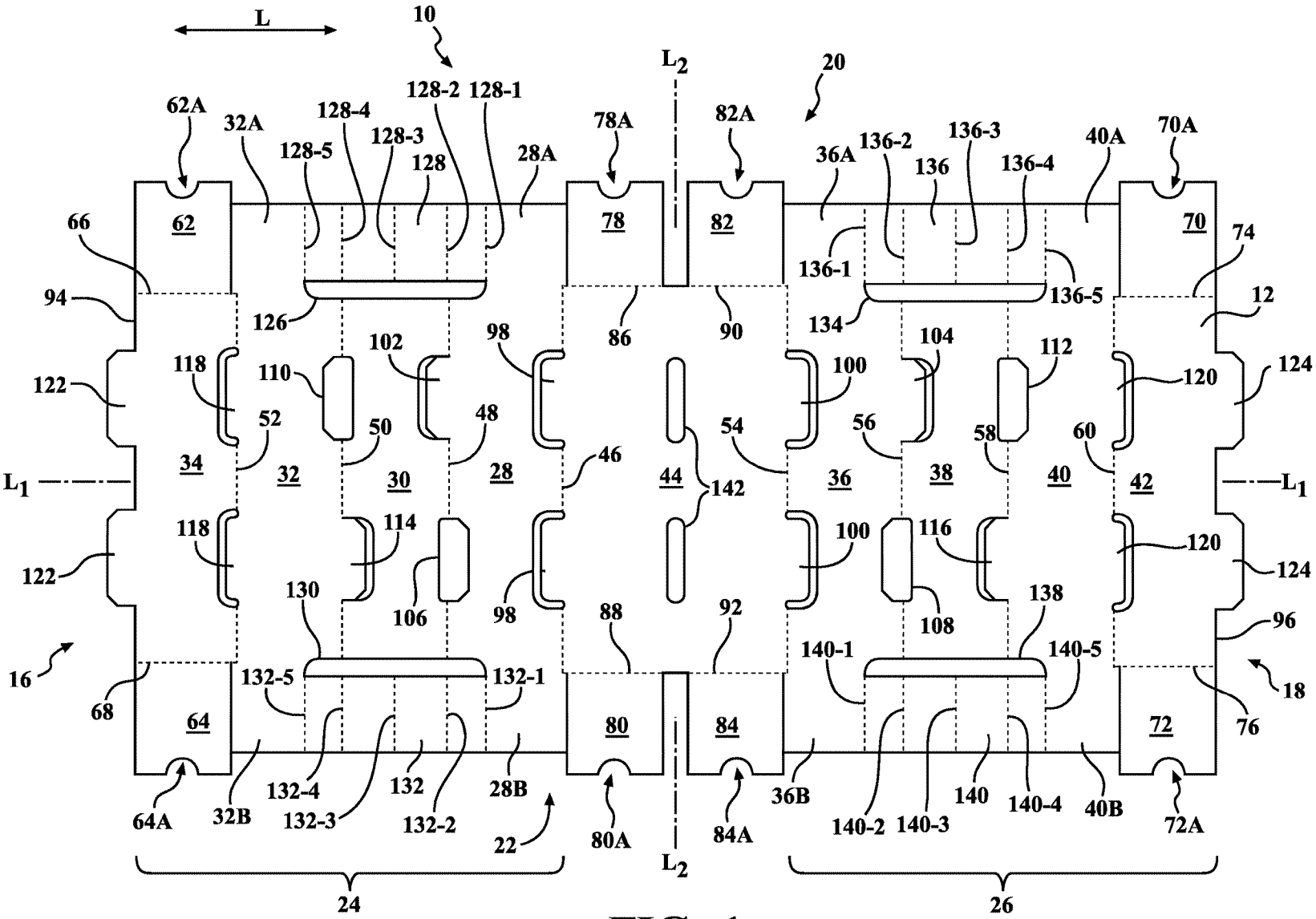
FIG. 1 is a plan view of a blank for forming an insert.

The present description is directed to a container construction comprising a one-piece blank that is folded to form a shipping insert comprising two internal receiving areas for receiving a product. One or more inserts may be placed in, for example, a regular slotted carton for shipping. With reference to FIG. 1, a one-piece blank 10 is shown for illustrating one or more aspects of a shipping insert 150 described herein (see FIGS. 4A and 4B). The blank 10 may be formed of a sheet of corrugated board material and may be die cut to the shape shown herein, although other materials and variations of the illustrated shape may be provided within the scope of the containers described and claimed herein. In some examples, the sheet material may comprise double-wall corrugated board, and in other examples, the sheet material may comprise single-wall corrugated board. The blank 10 illustrated in FIG. 1 is a planar piece of material in which an inner surface 12 is shown facing out of the page and an outer surface 14 (see FIG. 2) is facing an opposite direction from the inner surface 12. The blank 10 extends in a longitudinal direction L between first and second longitudinal ends, generally designated 16 and 18, respectively, along line $L_1$, which defines a longitudinal axis of the blank 10. The blank 10 extends in a lateral direction between first and second lateral edges, generally designated 20 and 22, respectively, along line $L_2$, which defines a lateral axis of the blank 10. The line $L_2$ also defines a longitudinal axis of the assembled insert 150 (see FIGS. 4A and 4B).

The blank 10 comprises a first section 24 and a second section 26 joined at a base panel 44. The first section 24 comprises a first panel 28, a second panel 30, a third panel 32, and a fourth panel 34. The second section 26 comprises a fifth panel 36, a sixth panel 38, a seventh panel 40, and an eighth panel 42. The panels forming each of the first and second halves 24, 26 are connected in series, in which fold lines are represented by a dash-dot line.

The base panel 44 is connected along a first side to the first panel 28 at a lateral fold line 46 (also referred to herein as a first fold line) and along a second side to the fifth panel 36 at a lateral fold line 54 (also referred to herein as a second fold line). The first panel 28 is connected to the second panel 30 at a lateral fold line 48; the second panel 30 is connected to the third panel 32 at a lateral fold line 50; and the third panel 32 is connected to the fourth panel 34 at a lateral fold line 52. The fifth panel 36 is connected to the sixth panel 38 at a lateral fold line 56; the sixth panel 38 is connected to the seventh panel 40 at a lateral fold line 58; and the seventh panel 40 is connected to the eighth panel 42 at a lateral fold line 60. As described herein, the lateral fold lines 46-60 may be discontinuous.

The blank 10 may be substantially symmetrical along line $L_2$ such that the first section 24 of the blank 10 is a mirror image of the second section 26 and the first panel 28 is substantially similar in structure to the fifth panel 36, the second panel 30 is substantially similar in structure to the sixth panel 38, and so on. In some examples, a longitudinal length of the first 28, extending in the longitudinal direction L between the fold lines 46, 48, may be substantially equal to a longitudinal length of the fifth panel 36, which extends in the longitudinal direction between the fold lines 54, 56. Likewise, a longitudinal length of the second and fourth panels 30, 38, as defined in the longitudinal direction L between respective pairs of fold lines 48, 50 and 56, 58, may be substantially equal, and a longitudinal length of the third and seventh panels 32, 40, as defined in the longitudinal direction L between respective pairs of fold lines 50, 52 and 58, 60, may be substantially equal. A longitudinal length of the fourth panel 34, as defined in the longitudinal direction L between the fold line 52 and the outer edge 94, may be substantially equal to a longitudinal length of the eighth panel 42, as defined in the longitudinal direction L between the fold line 60 and outer edge 96. The longitudinal lengths of the second, third, and fourth panels 30, 32, 34 may be substantially equal to each other and may each be less than the longitudinal length of the first panel 28. The longitudinal lengths of the sixth, seventh, and eighth panels 38, 40, 42 may be substantially equal to each other and may each be less than the longitudinal length of the fifth panel 36. A longitudinal length of the base panel 44, as defined in the longitudinal direction L between the fold lines 46, 54, may be substantially equal to the combined longitudinal lengths of the fourth and eighth panels 34, 42.

The fourth panel 34 may comprise end flaps 62, 64 (also referred to herein as a first pair of inner end flaps) that are foldably joined to laterally opposed ends of the fourth panel 34 along respective longitudinal fold lines 66, 68. The eighth panel 42 may comprise end flaps 70, 72 (also referred to herein as a second pair of inner end flaps) that are foldably joined to laterally opposed ends of the eighth panel 42 along respective longitudinal fold lines 74, 76. The base panel 44 may comprise a first pair of end flaps 78, 80 (also referred to herein as a first pair of outer end flaps) and a second pair of end flaps 82, 84 (also referred to herein as a second pair of outer end flaps) that are each foldably joined to laterally opposed ends of the base panel 44 along respective fold lines 86, 88, 90, 92. As shown in FIG. 1, the end flaps 62, 64, 70, 72, 78, 80, 82, 84 may extend laterally outward past a laterally outer edge of adjacent ones of panels 28-42. To assist in folding, fold lines 66, 68, 74, 76, 86, 88, 90, 92 may optionally include perforations or scoring on the inner surface 12, in which the perforations extend completely through a thickness of the blank 10.

The first longitudinal end 16 of the blank 10 may comprise an outer edge 94 of the fourth panel 34 and longitudinally outer edges (not separately labeled) of the end flaps 62, 64. The second longitudinal end 18 of the blank 10 may be formed by an outer edge 96 of the eighth panel 42 and longitudinally outer edges (not separately labeled) of the end flaps 70, 72. Each of the end flaps 62, 64, 70, 72, 78, 80, 82, 84 may comprise a respective cutout 62A, 64A, 70A, 72A, 78A, 80A, 82A, 84A extending inward in a substantially lateral direction from an outer edge of the end flap 62, 64, 70, 72, 78, 80, 82, 84, i.e., from a respective one of the first or second lateral edges 20, 22 of the blank 10. The cutouts 62A, 64A, 70A, 72A, 78A, 80A, 82A, 84A may be rounded.

As shown in FIG. 1, the blank 10 may comprise multiple areas where a section or portion of material is removed to define one of a popout tab or a slot. Sections of material may be removed from the first panel 28 to define a pair of popout tabs 98 extending longitudinally outward from the base panel 44 toward the first longitudinal end 16 of the blank 10. A corresponding section of material may be removed from the fifth panel 36 to define another pair of popout tabs 100 extending longitudinally outward from the base panel 44 toward the second longitudinal end 18 of the blank 10. The popout tabs 98, 100 may extend laterally between sections of the respective fold lines 46, 54 (which may be discontinuous) and may extend longitudinally outward from the fold lines 46, 54 toward a respective longitudinal end 16, 18 of the blank 10, such that the popout tabs 98, 100 remain in a same plane as the base panel 44 when the first and fifth panels 28, 36 are folded along their respective fold lines 46, 54, as described herein.

A section of material may be removed from the second panel 30 to define a popout tab 102, in which the popout tab 102 extends longitudinally outward from the first panel 28 toward the first longitudinal end 16 of the blank 10. A corresponding section of material may be removed from the sixth panel 38 to form a popout tab 104, in which the popout tab 104 extends longitudinally outward from the fifth panel 36 toward the second longitudinal end 18 of the blank 10. The popout tabs 102, 104 may extend laterally between sections of the respective fold lines 48, 56 (which may be discontinuous) and may extend longitudinally outward from the fold lines 48, 56 toward respective longitudinal end 16, 18 of the blank 10, such that the popout tabs 102, 104 remain in a same plane as a respective one of the first and fifth panels 28, 36 when the second and sixth panels 30, 38 are folded along their respective fold lines 48, 56, as described herein. A section of material may be removed from the first and second panels 28, 30 to form a slot 106, and a corresponding section of material may be removed from the fifth and sixth panels 36, 38 to form a slot 108. The slots 106, 108 may extend laterally between sections of the respective fold lines 48, 56 (which may be discontinuous) and may be formed such that the slots 106, 108 extend longitudinally across the first and second panels 28, 30 and the fifth and sixth panels 36, 38, respectively.

With continued reference to FIG. 1, another section of material may be removed from the second panel 30 to define a popout tab 114 that extends longitudinally outward from the third panel 32 toward the second longitudinal end 18 of the blank 10. A corresponding section of material may be removed from the sixth panel 38 to define a popout tab 116 that extends longitudinally outward from the seventh panel 40 toward the first longitudinal end 16 of the blank 10. The popout tabs 114, 116 may extend laterally between sections of the respective fold lines 50, 58 (which may be discontinuous) and may extend longitudinally outward from the fold lines 50, 58 toward respective longitudinal ends 16, 18 of the blank 10, such that the popout tabs 114, 116 remain in a same plane as a respective one of the third and seventh panels 32, 40 when the third and seventh panels 32, 40 are folded along their respective fold lines 50, 58, as described herein. A section of material may be removed from the second and third panels 30, 32 to form a slot 110, and a corresponding section of material may be removed from the sixth and seventh panels 38, 40 to form a slot 112. The slots 110, 112 may extend laterally between sections of the respective fold lines 50, 58 (which may be discontinuous) and may be formed such that the slots 110, 112 extend longitudinally into the second and third panels 30, 32 and the sixth and seventh panels 38, 40, respectively. As shown in FIG. 1, the popout tabs 102, 104 and the slots 110, 112 may be located toward the first lateral edge 20 of the blank 10, while the slots 106, 108 and the popout tabs 114, 116 may be located toward the second lateral edge 22 of the blank 10. The popout tabs 102 and 104 may be across from a respective one of the slots 110 and 112, in the longitudinal direction L. Likewise, the slots 106 and 108 may be across from a respective one of the popout tabs 114 and 116, in the longitudinal direction L.

Sections of material may be removed from the fourth panel 34 to define a pair of popout tabs 118 extending longitudinally outward from the third panel 32 toward the first longitudinal end 16 of the blank 10. A corresponding section of material may be removed from the eighth panel 42 to define a pair of popout tabs 120 extending longitudinally outward from the seventh panel 40 toward the second longitudinal end 18 of the blank 10. The popout tabs 118, 120 may extend laterally between sections of the respective fold lines 52, 60 (which may be discontinuous) and may extend longitudinally outward from the fold lines 52, 60 toward respective longitudinal ends 16, 18 of the blank 10, such that the popout tabs 118, 120 remain in a same plane as the third and seventh panels 32, 40 when the fourth and eighth panels 34, 42 are folded along their respective fold lines 52, 68, as described herein. The fourth panel 34 comprises a pair of tabs 122 extending outwardly in the longitudinal direction away from the outer edge 94 of the fourth panel 34. The eighth panel 42 comprises a pair of tabs 124 extending outwardly in the longitudinal direction away from the outer edge 96 of the eighth panel 42.

As shown in FIG. 1, a central portion of the base panel 44 comprises two elongated apertures 142 extending in the lateral direction. As described in more detail herein, the elongated apertures 142 are designed to receive respective ones of the tabs 122, 124 formed on the outer edges 94, 96 of the fourth and eighth panels 34, 42, respectively.

In the first section 24 of the blank 10, first and second opposing outer ends (not separately labeled) of the first panel 28 comprise lateral extensions 28A, 28B, and first and second opposing outer ends (not separately labeled) of the third panel 32 comprise lateral extensions 32A, 32B. A locking panel 128 is defined in the lateral direction between the first lateral edge 20 of the blank 10 and an elongated slot 126 that is located laterally inward from the first lateral edge 20. The locking panel 128 and the elongated slot 126 extend in the longitudinal direction L between the lateral extensions 28A, 32A on the first opposing ends of the first and third panels 28, 32, i.e., the lateral extensions 28A, 32A located along the first lateral edge 20 of the blank 10. The locking panel 128 includes fold lines 128-1 to 128-5, in which fold line 128-2 aligns, in the lateral direction, with fold line 48, and fold line 128-4 aligns, in the lateral direction, with fold line 50. A locking panel 132 is defined in the lateral direction between the second lateral edge 22 of the blank 10 and an elongated slot 130 that is located laterally inward from the second lateral edge 22. The locking panel 132 and the elongated slot 130 extend in the longitudinal direction L between the lateral extensions 28B, 32B on the second opposing ends of the first and third panels 28, 32, i.e., the lateral extensions 28B, 32B located along the second lateral edge 22 of the blank 10. The locking panel 132 includes fold lines 132-1 to 132-5, in which fold line 132-2 aligns, in the lateral direction, with fold line 48, and fold line 132-4 aligns, in the lateral direction, with fold line 50.

The second section 26 of the blank 10 comprises a substantially similar configuration. First and second opposing outer ends (not separately labeled) of the fifth panel 36 comprise lateral extensions 36A, 36B, and first and second opposing outer ends (not separately labeled) of the seventh panel 40 comprise lateral extensions 40A, 40B. A locking panel 136 is defined in the lateral direction between the first lateral edge 20 of the blank 10 and an elongated slot 134 that is located laterally inward from the first lateral edge 20. The locking panel 136 and the elongated slot 134 extend in the longitudinal direction L between the lateral extensions 36A, 40A on the first opposing ends of the fifth and seventh panels 36, 40, i.e., the lateral extensions 36A, 40A located along the first lateral edge 20 of the blank 10. A locking panel 140 is defined in the lateral direction between the second lateral edge 22 of the blank 10 and an elongated slot 138 that is located laterally inward from the second lateral edge 22. The locking panel 140 and the elongated slot 138 extend in the longitudinal direction L between the lateral extensions 36B, 40B on the second opposing ends of the fifth and seventh panels 36, 40, i.e., the lateral extensions 36B, 40B located along the second lateral edge 22 of the blank 10. The locking panel 136 includes fold lines 136-1-1 to 136-5-5, and the locking panel 140 includes fold lines 140-1 to 140-5, in which fold lines 136-2 and 140-2 align, in the lateral direction, with fold line 56, and fold lines 136-4 and 140-4 align, in the lateral direction, with fold line 58.

Figure 2:
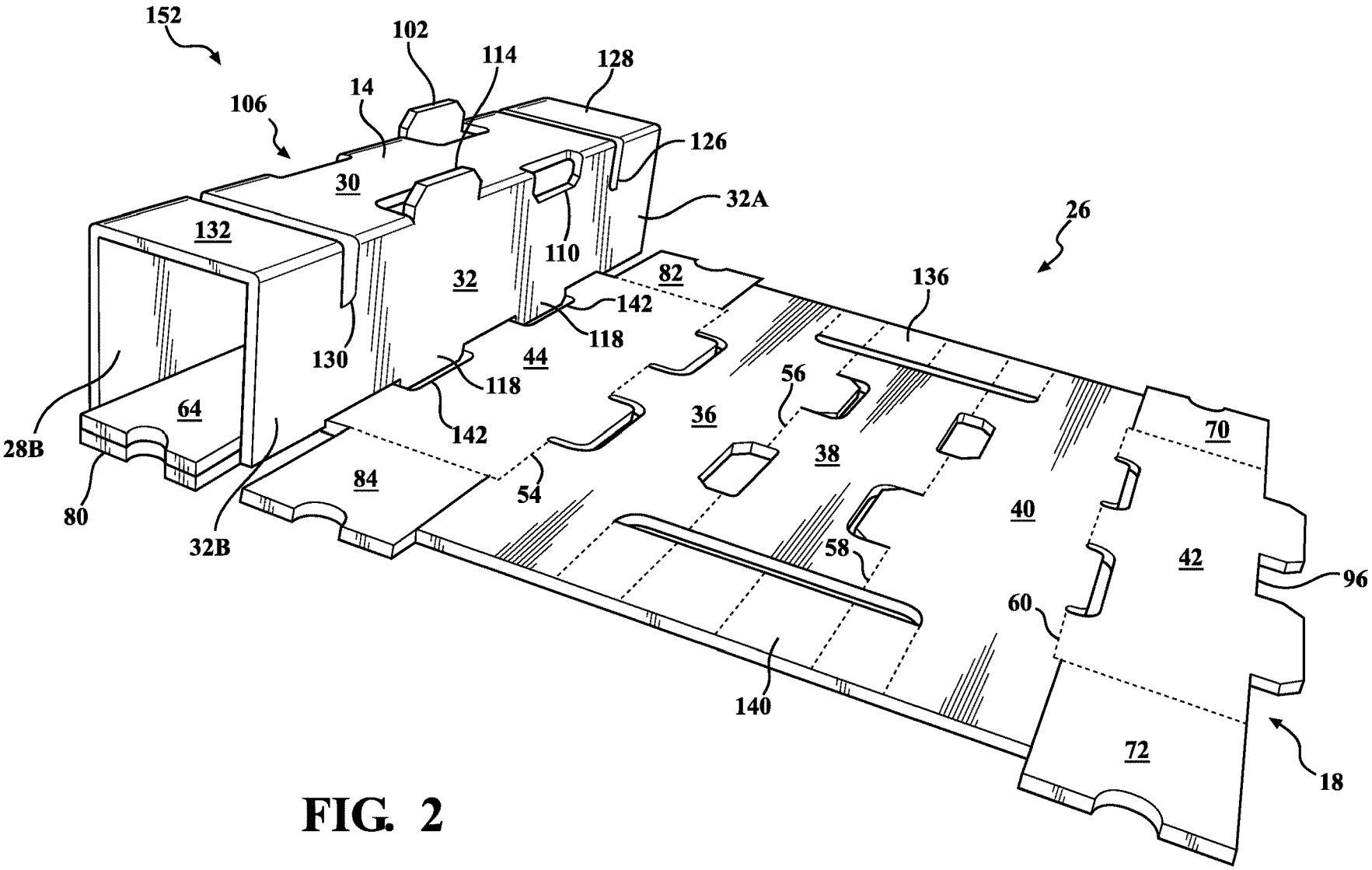
FIG. 2 is a perspective view of the blank of FIG. 1 in which a first half of the blank has been assembled.
Figure 3A:
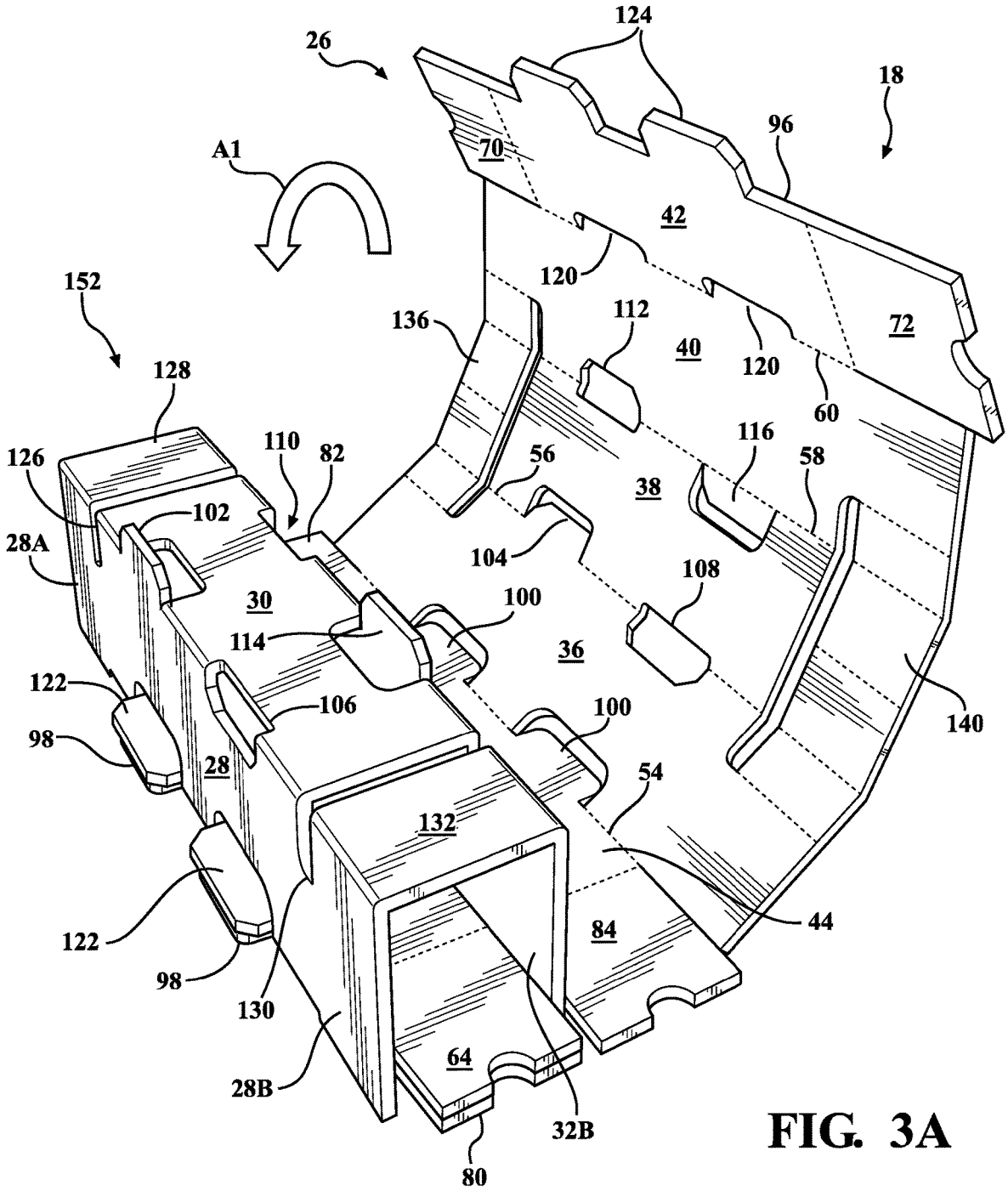
FIG. 3A is a perspective view illustrating partial completion of a folding operation of the second half of the blank of FIG. 2.
Figure 3B:
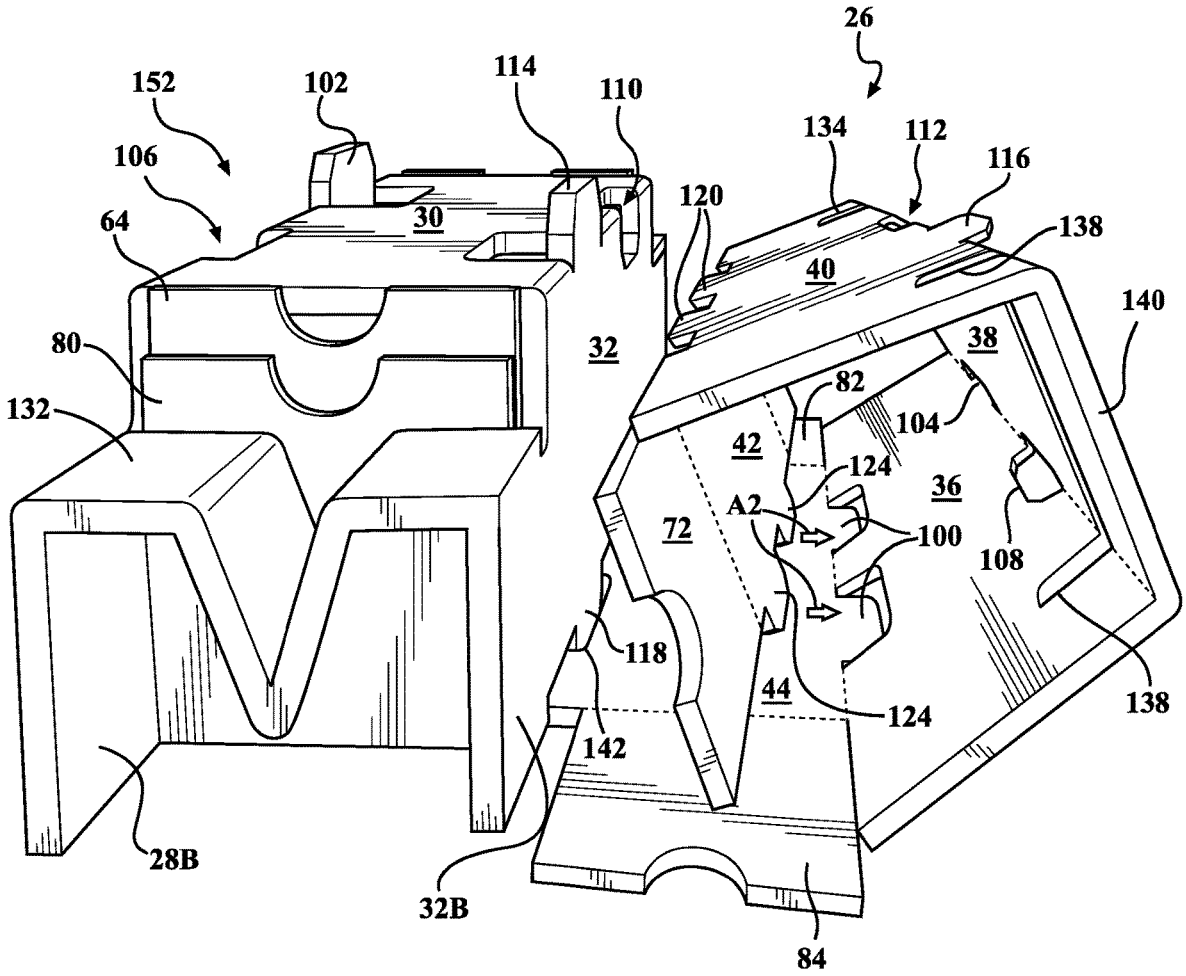
FIG. 3B is a perspective view illustrating a final step in completion of the folding operation of the second half of the blank of FIG. 3.

A series of steps for performing a folding operation using the blank 10 of FIG. 1 to form the insert 150 of FIGS. 4A and 4B will now be described with respect to FIGS. 2, 3A, and 3B. As described herein, a first half 52 of the insert 150 comprises a first plurality of panels connected in series at respective fold lines, e.g., panels 28-34 connected in series at fold lines 48-52 and comprising the first section 24 of the blank 10 of FIG. 1, and a second half 154 of the insert 150 comprises a corresponding, second plurality of panels connected in series at respective fold lines, e.g., panels 36-42 connected in series at fold lines 56-60 and comprising the second section 26 of the blank 10. In FIGS. 2, 3A, and 3B, the panels 28-34 comprising the first section 24 of the blank 10 are in their respective folded positions to form the first half 152 of the insert 150, and the folding operation is described in detail with respect to the panels 36-42 comprising the second section 26 of the blank 10.

With reference to FIGS. 2 and 3A, the second section 26 of the blank 10 may be transitioned from its flat, unfolded position in FIG. 2 by "rolling" the second longitudinal end 18 of the blank 10 in the direction indicated by the arrow A1 toward the first half 152 of the insert 150 and toward the base panel 44, as shown in FIG. 3A. This motion causes the panels 36, 38, 40, 42 to begin folding substantially simultaneously along their respective fold lines 54, 56, 58, 60. Although not shown, it would be understood that one or more of the panels 36-42 could be folded individually. For example, with reference to FIG. 2, the eighth panel 42 may be folded upward along the fold line 60 to a generally vertical position, e.g., at approximately 90° with respect to the seventh panel 40; the seventh panel 40 (along with the folded eighth panel 42) may be folded upward along the fold line 58 to a generally vertical position, e.g., at approximately 90° with respect to the sixth panel 38, and so on.

As shown in FIG. 3A, it can be seen that as the panels 36-42 begin to fold along their respective fold lines 54-60, the popout tabs 100, 104, 116, 120 begin to emerge. In particular, as the fifth panel 36 folds along the fold line 54, the popout tabs 100 extending longitudinally outward from the base panel 44 toward the second longitudinal end 18 of the blank 10 remain in the same plane as the base panel 44. As the sixth panel 38 folds along the fold line 56, the popout tab 104 extending longitudinally outward from the fifth panel 36 toward the second longitudinal end 18 remains in the same plane as the fifth panel 36. As the seventh panel 40 folds along the fold line 58 and the eight panel 42 folds along the fold line 60, the popout tab 116 extending longitudinally outward from the seventh panel 40 toward the first longitudinal end 16 (i.e., toward the first half 152 of the insert 150) and the popout tabs 120 extending longitudinally outward from the seventh panel 40 toward the second longitudinal end 18 all remain in the same plane as the seventh panel 40. In addition, as the sixth and seventh panels 38 and 40 begin to fold along the fold lines 56 and 58, respectively, the locking panels 136 and 140 also begin to fold along fold lines 136-2, 136-4 and 140-2, 140-4, which align respectively with fold lines 56 and 58.

Figure 4A:
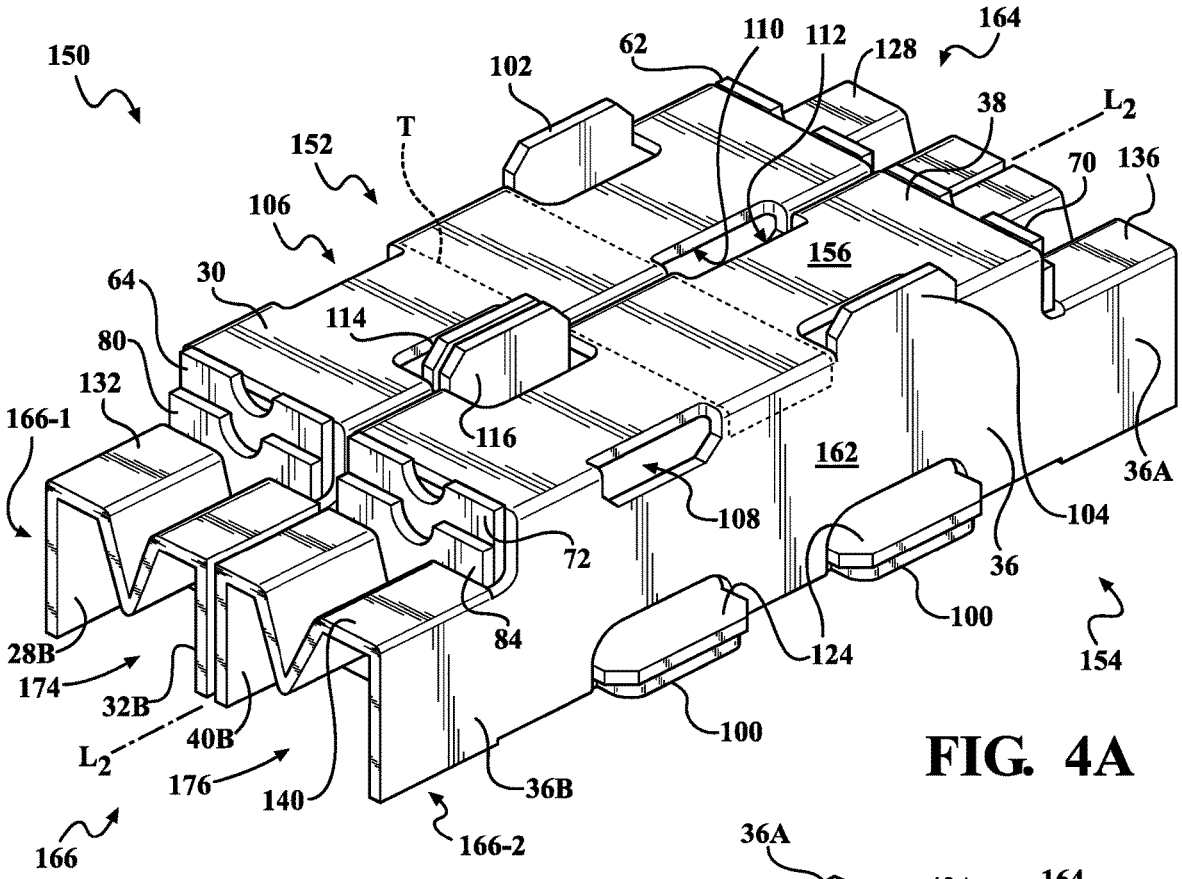
FIGS. 4A and 4B are perspective views illustrating a completed insert.
Figure 4B:
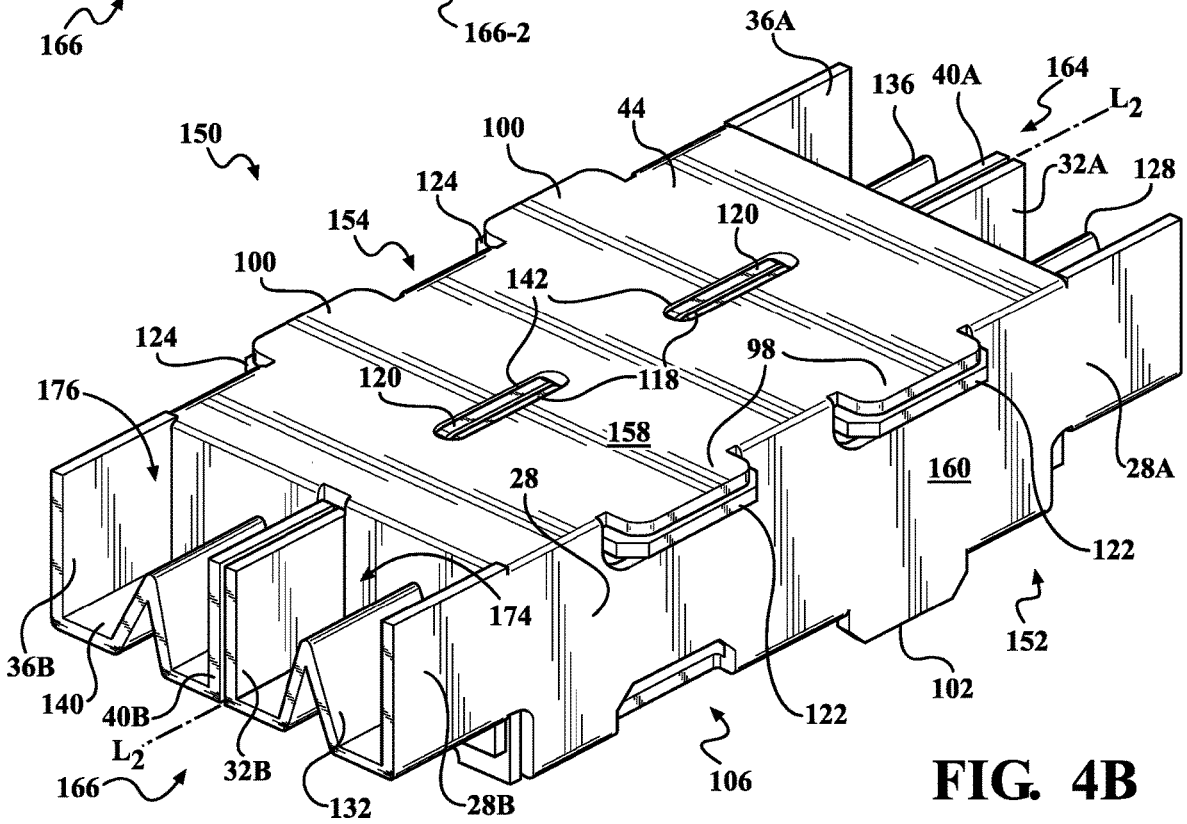

With reference to FIGS. 3B, 4A, and 4B, the folding operation is completed by folding the panels 36-42 in a direction shown by arrow A2, such that the eighth panel 42 is on top of and parallel to the base panel 44. The tabs 124 extending outwardly in the longitudinal direction from the outer edge 96 (see FIG. 3A) of the eighth panel 42 extend through an opening (not separately labeled) in the fifth panel 36 that is formed by the removal of material to create the popout tabs 100 extending outwardly from the base panel 44, such that the tabs 124 are on top of and parallel to the popout tabs 100. The popout tabs 120 extending outwardly from the seventh panel 40 are received in respective ones of the elongated apertures 142 formed in the base 44, such that the seventh panel 40 is adjacent to and parallel to the third panel 32 and the popout tabs 120 are adjacent to corresponding ones of the popout tabs 118 that are also received in the elongated apertures 142 (see also FIG. 2).

At the conclusion of the folding operation of the second section 26 of the blank 10, the sixth and eighth panels 38, 42 are substantially parallel to the base panel 44, and the fifth and seventh panels 36, 70 are substantially perpendicular, e.g., at approximately 90°, to the base panel 44 and the sixth and eighth panels 38, 42. The end flap 72 extending outwardly from the eighth panel 42 is on top of and parallel to the end flap 84 ending outwardly from the base panel 44. Although not visible, the end flap 70 (see FIGS. 2 and 3A) extending outwardly from the laterally opposed end of the eighth panel 42 is also on top of and parallel to the end flap 82 extending outwardly from the laterally opposed end of the base panel 44. The popout tab 116 extending outwardly from the seventh panel 40 is adjacent to and parallel to the corresponding popout tab 114 extending outwardly from the third panel 32. The slot 112 formed in the sixth and seventh panels 38, 40 is adjacent to and adjoins with the slot 110 formed in the second and third panels 30, 32.

Although not described in detail, it is to be understood that the first half 152 of the insert 150 is formed by folding the first section 24 of the blank 10 in a similar manner, such that the fourth panel 34 is on top of the base panel 44; the second and fourth panels 30, 34 are substantially parallel to the base panel 44; and the first and third panels 28, 32 are substantially perpendicular, e.g., at approximately 90°, to the base panel 44 and the second and fourth panels 30, 34. The tabs 122 extending outwardly from the fourth panel 34 are on top of and parallel to the tabs 98 extending outwardly from the base panel 44, and the end flaps 62, 64 extending outwardly from laterally opposed ends of the fourth panel 34 are on top of and parallel to respective ones of the first pair of end flaps 78, 80 extending outwardly from the base panel 44, as shown in FIGS. 2, 3A, and 3B.

With reference to FIGS. 4A and 4B, the second and sixth panels 30, 38 together form a first face or side 156 of the insert 150 (also referred to herein as a front face or side). The base panel 44 and the fourth and eighth panels 34, 42 together form a second face or side 158 of the insert 150 (also referred to herein as a back face or side), in which the base panel 44 is parallel to the fourth and eight panels 34, 42. The first panel 28 forms a third face or side 160 of the insert 150, and the fifth panel 36 forms a fourth face or side 162 of the insert 150. A first end 164 of the insert 150 comprises the lateral extensions 28A, 32A, 36A, 40A extending from one end of the first, third, fifth, and seventh panels 28, 32, 36, 40, respectively. As described herein, the first end 164 may further comprise the locking panels 128, 136 and the inner and outer end flaps 62, 70, 78, 82 located along the first lateral edge 20 of the blank 10 (see FIG. 1). A second end 166 of the insert 150 comprises the lateral extensions 28B, 32B, 36B, 40B extending from the other end of the first, third, fifth, and seventh panels 28, 32, 36, 40, respectively. As described herein, the second end 166 may further comprise the locking panels 132, 140 and the inner and outer end flaps 64, 72, 80, 84 along the second lateral edge 22 of the blank 10 (see FIG. 1). A strip of tape T may be placed across the front face 156 of the insert 150 and may extend at least partially onto the third and fourth faces 160, 162 to secure the first and second half 152, 154 of the insert 150 together and to prevent them from unfolding. In general, no glue or other type of adhesive is needed to maintain the insert 150 in its folded position.

Figure 5A:
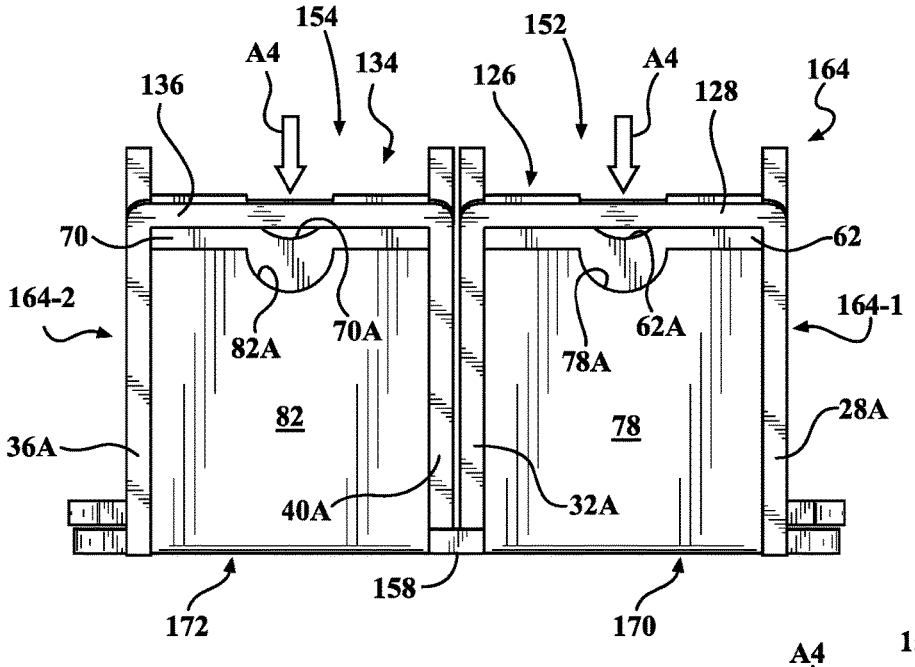
FIG. 5A is a detailed end view of a first end of the insert of FIG. 4A, in which a locking panel is in an open or unfolded position.
Figure 5B:
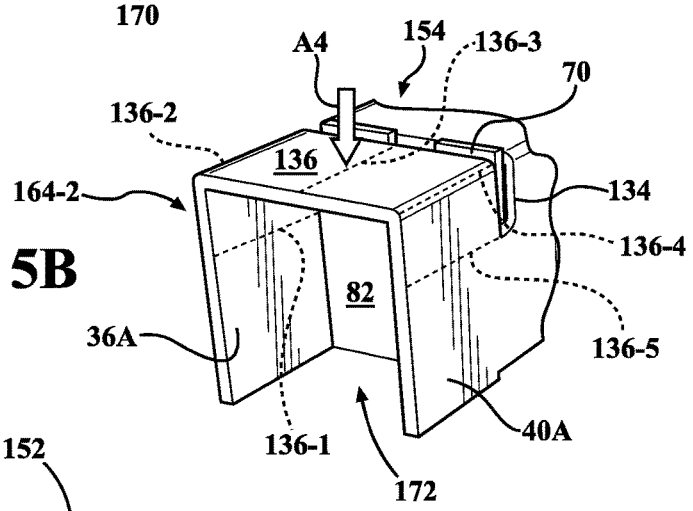
FIG. 5B is a perspective view of the first end of the insert of FIG. 5A.

As shown in FIGS. 5A and 5B, the first and second half 152, 154 of the insert 150 each comprise a respective first end portion 164-1, 164-2. The first end portion 164-1 of the first half 152 comprises the locking panel 128, the lateral extensions 28A, 32A extending from one end of the first and third panels 28, 32, and one end flap from each of the first pair of inner and outer end flaps, e.g., end flaps 62 and 78. The first end portion 164-2 of the second half 154 comprises the locking panel 136, the lateral extensions 36A, 40A extending from one end of the fifth and seventh panels 36, 40, and one end flap from each of the second pair of inner and outer end flaps, e.g., end flaps 70, 82. Both of the first end portions 164-1, 164-2 are enclosed on three sides, with the locking panels 128, 136 defining a respective first side and respective pairs of the lateral extensions 28A, 32A and 36A, 40A being located opposite each other and defining at least a portion of respective second and third sides of the first end portions 164-1, 164-2. A respective fourth side of each of the first end portions 164-1, 164-2, i.e., a side that is in the same plane as the back face 158 (i.e., the base panel 44, see FIG. 1), comprises an open area 170, 172. The locking panels 128, 136 each form an entirety of the first side that is located opposite the open area 170, 172. In some examples, the locking panels 128, 136 may also define a remaining portion of the second and third sides of the respective first end portions 164-1, 164-2.

As shown in FIGS. 4A and 4B, the first and second half 152, 154 of the insert 150 each comprise a respective second end portion 166-1, 166-2. The second end portion 166-1 of the first half 152 comprises the locking panel 132, the lateral extensions 28B, 32B extending from a second, opposing end of the first and third panels 28, 32, and the other end flap from each of the first pair of inner and outer end flaps, e.g., end flaps 64, 80. The second end portion 166-2 of the second half 154 comprises the locking panel 140, the lateral extensions 36B, 40B extending from a second, opposing end of the fifth and seventh panels 36, 40, and the other end flap from each of the second pair of inner and outer end flaps, e.g., end flaps 72, 84. Both of the second end portions 166-1, 166-2 are enclosed on three sides, as described with respect to the first end portions 164-1, 164-2, with the locking panels 132, 140 defining respective first sides of the second end portions 166-1, 166-2 and respective pairs of the lateral extensions 28B, 32B and 36B, 40B defining at least a portion of respective second and third sides. A respective fourth side of each second end portion 166-1, 166-2 comprises an open area 174, 176, and the locking panels 132, 140 each form an entirety of the first side that is located opposite the open area 174, 176. In some examples, the locking panels 132, 140 may also define a remaining portion of the respective second and third sides.

Figure 5C:
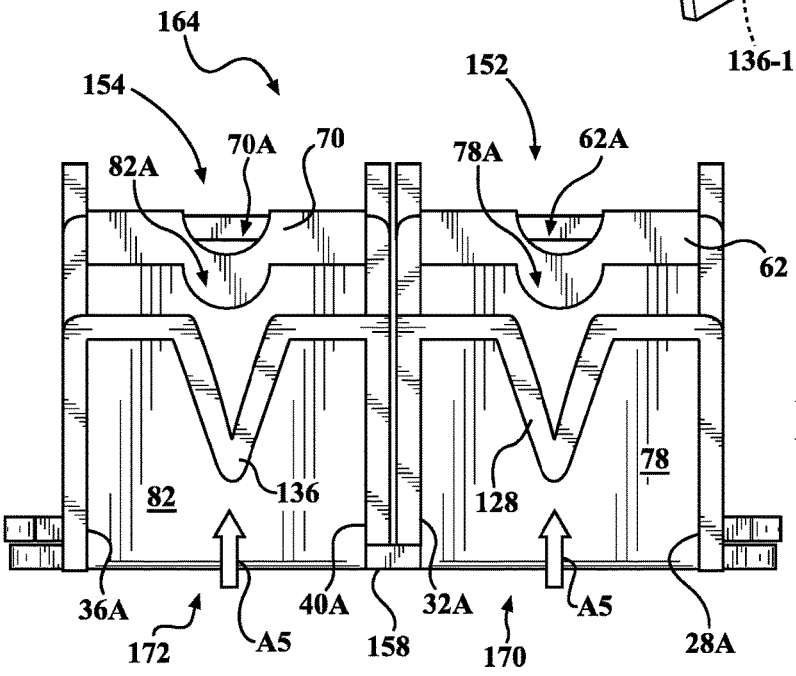
FIG. 5C is an end view of the first end of the insert of FIG. 5A, in which the locking panel is in a locked or folded position.
Figure 8:
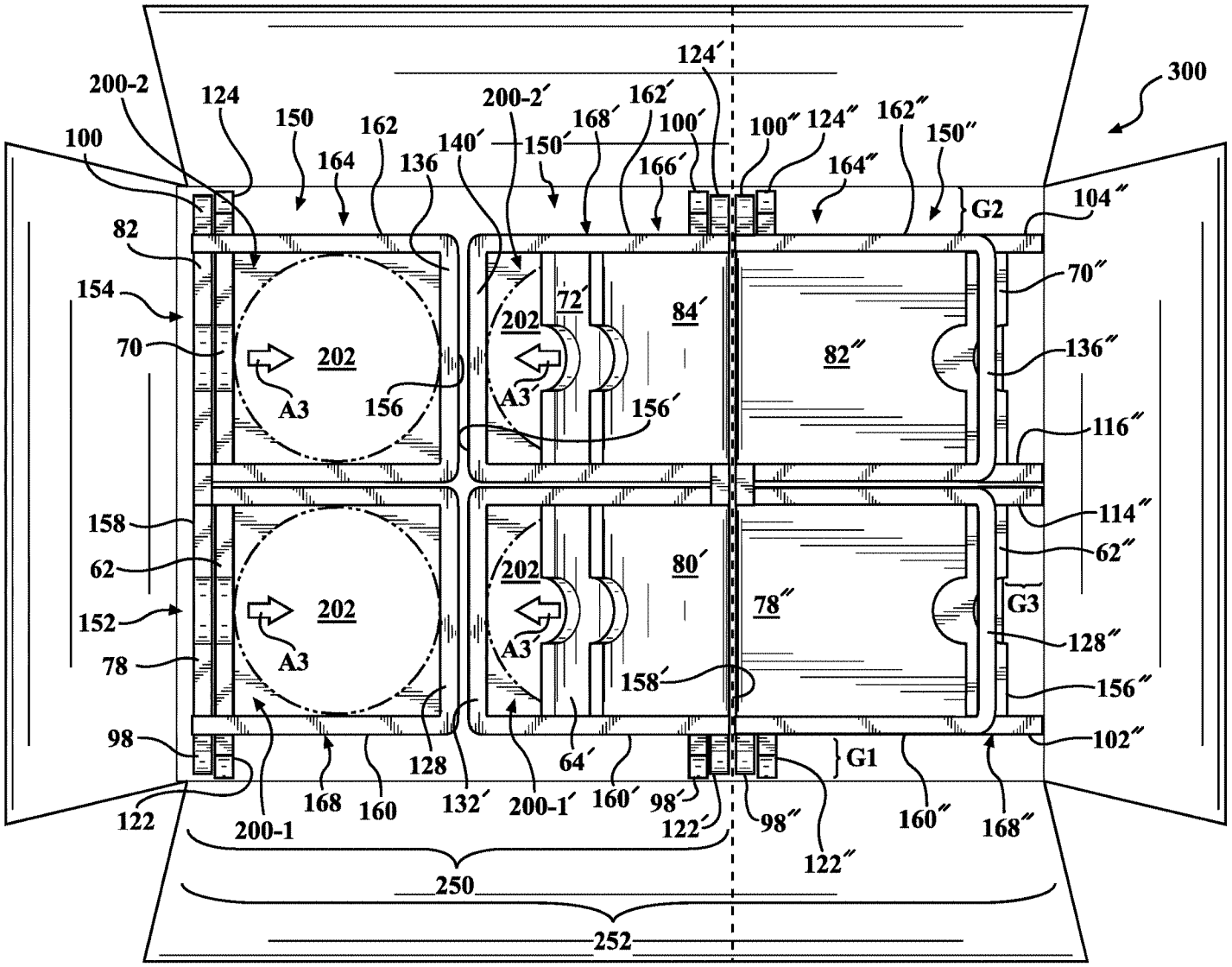
FIG. 8 is a top view of three inserts in a carton.

The locking panels 128, 132, 136, 140 and the end flaps 62, 64, 70, 72, 78, 80, 82, 84 function to close and secure the respective ends 164, 166 of the insert 150. FIGS. 5A-5C and 8 illustrate closure of the ends 164, 166 in more detail. FIGS. 5A-5C are detailed views of the first end 164 of the insert 150 shown in FIGS. 4A and 4B, in which FIGS. 5A and 5B are end and perspective views, respectively, of the first end 164 following folding of the end flaps 62, 70, 78, 82 and prior to folding of the locking panels 128, 136 (i.e., the locking panels 128, 136 are in an open or unfolded position) and FIG. 5C is an end view of the first end 164 following folding of the locking panels 128, 136 on both halves 152, 154 of the insert 150 (i.e., the locking panels 128, 136 are in a folded or locked position). FIG. 8 is a top view of first, second, and third inserts 150, 150', 150", in which the first ends 164, 164" of the first and third inserts 150, 150" and the second end 166' of the second insert 150' are facing the viewer. As the first and second ends 164, 166 of each insert 150 are substantially similar in structure, the process for opening and closing the first and second ends 164, 166 is the same, and the steps are described herein interchangeably with respect to the first and second ends 164, 166 of the insert 150.

With reference to FIG. 8, folding and closure of the end flaps are illustrated in more detail. The locking panels 128, 128", 132', 136, 136", 140' of the three inserts 150, 150', 150" in FIG. 8 are all in their open or unfolded position, as described herein (see also FIGS. 5A and 5B). The end flaps 62, 70, 78, 82 on the first end 164 of the first insert 150 are all in their unfolded position, i.e., the end flaps 62, 70, 78, 82 are all in substantially the same plane as the base panel 44 and respective ones of the fourth and eighth panels 34, 42 (see FIGS. 1, 2, and 3A). To begin closing the first end 164, the inner end flaps 62, 70 are folded along their respective fold lines 66, 74 (see FIG. 1) in a direction toward their respective locking panel 128, 136, as shown by arrow A3. The outer end flaps 78, 82 are then folded along their respective fold lines 86, 90 (see FIG. 1) in the same direction over the folded inner end flaps 62, 70, respectively, and toward their respective locking panel 128, 136. The end flaps 62", 70", 78", 82" on the first end 164" of the third insert 150" in FIG. 8 are shown in their fully folded position. As shown with respect to the second insert 150', the second end 166' is closed in a substantially similar manner by folding the end flaps 64', 72', 80', 84' in a direction toward their respective locking panel 132', 140', as shown by arrow A3'. In FIG. 8, the end flaps 64', 72', 80', 84' on the second end 166' of the second insert 150' are depicted in their partially folded position (see also FIG. 4A, which depicts the end flaps 64, 72, 80, 84 of the second end 166 in their fully folded position).

With reference to FIGS. 1, 5A, and 5B, it can be seen that the inner end flaps 62, 70 extend laterally outward past the laterally outer edge of adjacent panels 34, 42, such that the inner end flaps 62, 70 are in their folded position, the inner end flaps 62, 70 extend above their respective (unfolded) locking panels 128, 136 and must be pushed past the locking panels 128, 136 until the end flaps 62, 70 are received in the respective elongated slot 126, 134 (see also the third insert 150" in FIG. 8). Thus, following folding of the end flaps 62, 78, 70, 82 and prior to folding of the locking panels 128, 136, the inner end flaps 62, 70 are held in their folded position by the locking panels 128, 136. Because the outer end flaps 78, 82 fold over the inner end flaps 62, 70, the outer end flaps 78, 82 stop short of the locking panels 128, 136 and are not received in the elongated slots 126, 134, as shown in FIGS. 5A and 5B. Although not discussed in detail herein, the inner end flaps 64, 72 on the second end 166 of the insert 150 likewise extend above their respective (unfolded) locking panels 132, 140 and must be pushed past the locking panels 132, 140 until the end flaps 64, 72 are received in the respective elongated slots 130, 138.

To complete closure of the first end 164, the locking panels 128, 136 are folded to secure respective ones of the inner and outer end flaps 62, 70, 78, 82 in their folded position. With reference to FIGS. 5A and 5B, the locking panel 136 of the first end portion 164-2 of the second half 154 is folded by pushing or pulling on the locking panel 136 in a direction shown by arrow A4, which causes the locking panel 136 to fold inward along fold lines 136-1 to 136-5 toward the back face 158 and toward the open area 172 of the first end portion 164-2. The locking panel 136 (when in its folded position) and the lateral extensions 36A, 40A form a shape substantially corresponding to a capital "M," as shown in FIG. 5C. The locking panel 128 of the first end portion 164-1 is similarly folded by pushing or pulling on the locking panel 128 in the direction shown by the arrow A4 in FIG. 5A, which causes the locking panel 128 to fold inward along fold lines 128-1 to 128-5 (see FIG. 1) toward the back face 158 and toward the open area 170 of the first end portion 164-1. The locking panel 128 (when in its folded position) and the lateral extensions 28A, 32A form a shape substantially corresponding to a capital "M," as shown in FIG. 5C. As shown in FIG. 5C, the locking panels 128, 136 are in their folded or locked position in which the locking panels 128, 136 extend over and secure the respective outer end flaps 78, 82 and prevent the inner and the outer end flaps 62, 70, 78, 82 from returning to their unfolded position, thereby closing the first end 164.

Although not shown in detail in FIGS. 5A-5C, closure of the second end 166 of the insert 150 may be completed in a substantially similar manner by folding the locking panels 132, 140 of the second end portions 166-1, 166-2 over respective ones of the end flaps 64, 72, 80, 84. The locking panels 132, 140 are folded by pushing or pulling on each locking panel 132, 140, which causes the locking panels 132, 140 to fold inward along their respective fold lines 132-1 to 132-5, 140-1, 140-5 (see FIG. 1) toward the back face 158 of the insert 150 and toward the respective open areas 174, 176 of the second end portions 166-1, 166-2. The locking panels 132, 140 (when in their folded positions) and their respective lateral extensions 28B, 32B, 36B, 40B form a shape substantially corresponding to a capital "M". The locking panels 132, 140 are then in their folded or locked position in which the locking panels 132, 140 extend over and secure the outer end flaps 80, 84 and prevent the inner and the outer end flaps 64, 72, 80, 84 from returning to their unfolded position, thereby closing the second end 166.

The first and second ends 164, 166 of the insert 150 may each be opened by reversing these steps to open one or both of the first and/or second end portions 164-1, 164-2, 166-1, 166-2. With reference to the first end 164 of the insert shown in FIGS. 5A-5C, the locking panels 128, 136 may be unfolded by pushing or pulling on the locking panels 128, 136 in a direction shown by arrow A5 in FIG. 5C, i.e., opposite to the direction shown by A4, such that the locking panels 128, 136 fold outward away from the back face 158 and return to their unfolded position shown in FIGS. 5A and 5B. The end flaps 62, 70, 78, 82 may then be unfolded by pulling them in a direction away from their respective locking panel 128, 136 and opposite the direction shown by arrows A3, A3' in FIG. 8. The cutouts 62A, 70A, 78A, 82A formed in each of the end flaps 62, 70, 78, 82 may assist a user with locating and grasping the end flaps 62, 70, 78, 82. The second end 166 of the insert 150 may be opened in a substantially similar manner by unfolding the locking panels 132, 140 and end flaps 64, 72, 80, 84 as described herein, in which the cutouts 64A, 72A, 80A, 84A may assist the user with locating and grasping the end flaps 64, 72, 80, 84.

The first and/or second ends 164, 166 of the insert 150 may be repeatedly opened and closed as described herein, such that the insert 150 may be reused multiple times. In addition, the insert 150 may be repeatedly assembled and disassembled (i.e., knocked down flat to the blank 10 shown in FIG. 1). For example, it may be desirable to unfold the insert 150 back to the flat blank 10 for storage and/or transport, as well as for disposal or recycling. The insert 150 may be made from corrugated board or other paperboard material(s), which may be recycled with other containers made of similar material.

With reference to FIGS. 1, 4A, 4B, and 8, the first half 152 of the insert 150 defines a first internal receiving area 200-1 for receiving a product 202, and the second half 154 of the insert defines a second internal receiving area 200-2 for receiving a product 202, in which each internal receiving area 200-1, 200-2 is defined by four side walls and two ends. First, second, and third side walls of the first internal receiving area 200-1 may be defined by the first, second, and third panels 28, 30, 32, respectively, of the blank 10; a fourth side wall may be defined by the combination of the fourth panel 34 and an adjacent half of the base panel 44 of the blank 10; and opposing ends of the first internal receiving area 200-1 may be defined by the first and second end portions 164-1, 166-1 of the first half 152 of the insert 150, which may comprise the first pair of inner end flaps 62, 64 on the fourth panel 34, the first pair of outer end flaps 78, 80 on the base panel 44, the lateral extensions 28A, 28B, 32A, 32B of the first and third panels 28, 32 of the blank 10, and the locking panels 128, 132, as described herein. Fifth, sixth, and seventh side walls of the second internal receiving area 200-2 may be defined by the fifth, sixth, and seventh panels 36, 38, 40, respectively, of the blank 10; an eighth side wall may be defined by the combination of the eighth panel 42 and the other half of the base panel 44 of the blank 10; and opposing ends of the second internal receiving area 200-2 may be defined by the first and second end portions 164-2, 166-2 of the second half 154 of the insert 150, which may comprise the second pair of inner end flaps 70, 72 on the eighth panel 42, the second pair of outer end flaps 82, 84 on the base panel 44, the lateral extensions 36A, 36B, 40A, 40B of the fifth and seventh panels 36, 40 of the blank 10, and the locking panels 136, 140, as described herein. The corresponding portions of the second and third inserts 150', 150" of FIG. 8 may likewise define first and second internal receiving areas 200-1', 200-1", 200-2', 200-2" for receiving a product 202.

Figure 6:
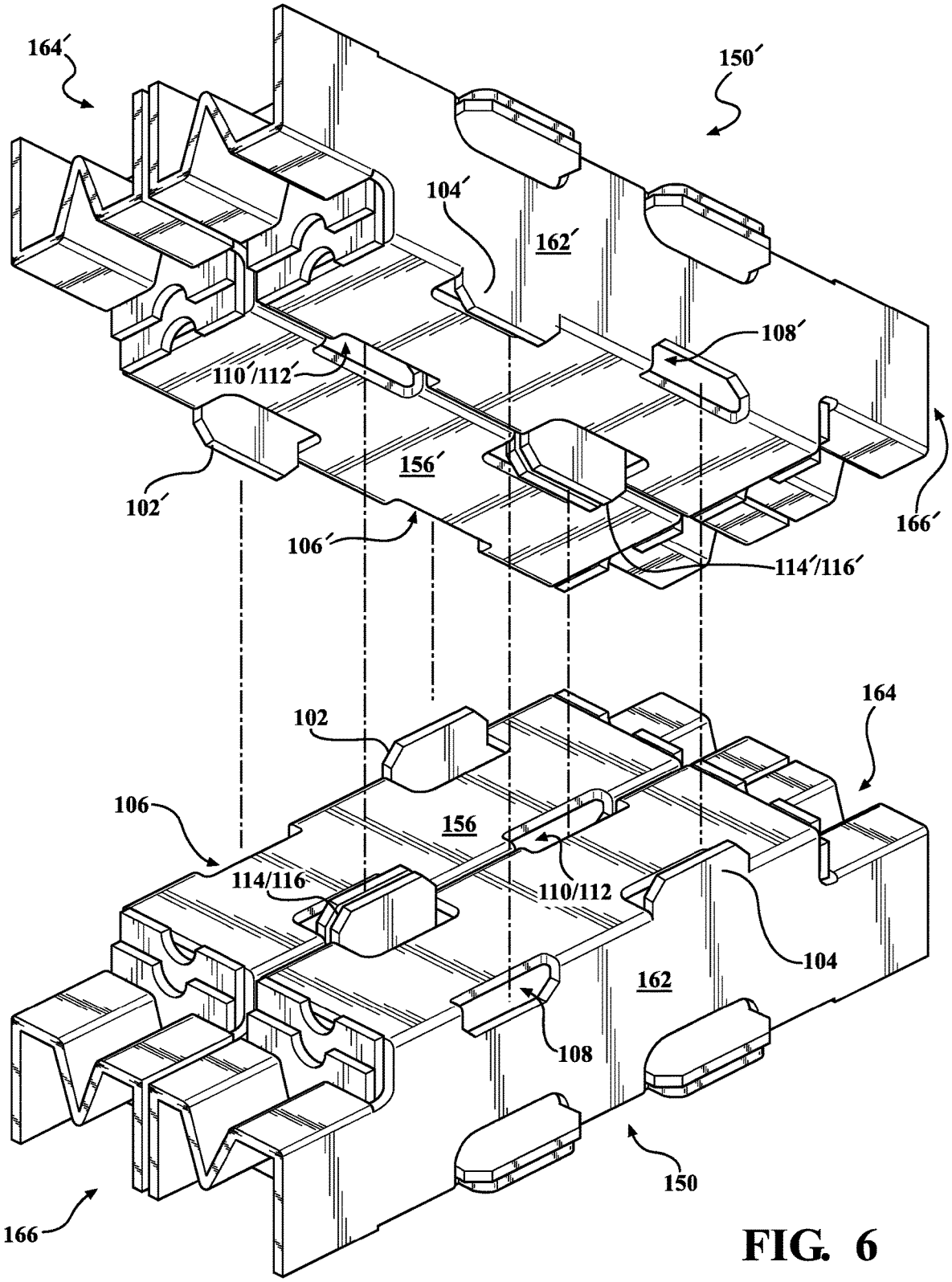
FIG. 6 is a perspective view illustrating nesting together of two inserts.
Figure 7:
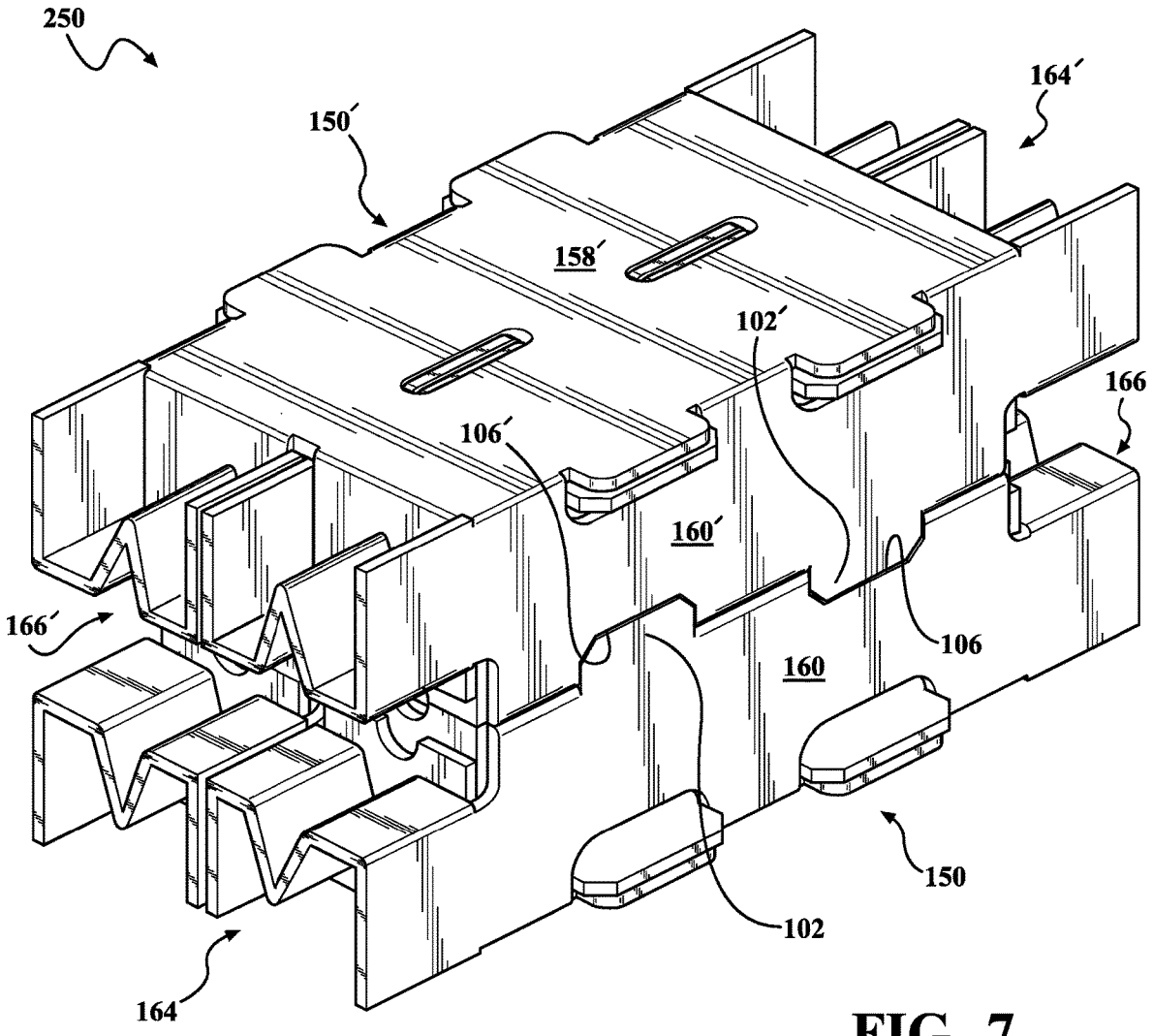
FIG. 7 is a perspective view illustrating the two inserts of FIG. 6 nested together.

The insert 150 as disclosed herein may be configured to be nested with a second insert 150. As shown in FIGS. 6 and 7, first and second inserts 150, 150' may be nested together such that the front faces 156, 156' of the inserts 150, 150' are in a facing relationship with each other and the respective back, third, and fourth faces 158, 158', 160, 160', 162, 162' of the inserts 150, 150' are facing outward. As seen in FIG. 6, the second insert 150' has been rotated 180° so that the first end 164 of the first insert 150 is across from the second end 166' of the second insert 150' and the second end 166 of the first insert 150 is across from the first end 164' of the second insert 150'. The popout tabs 102, 104 extending outward from the front face 156 of the first insert 150 are across from and received in respective ones of the slots 106', 108' formed in the front face 156' of the second insert 150'. The popout tabs 102', 104' extending outward from the front face 156' of the second insert 150' are across from and received in respective ones of the slots 106, 108 formed in the front face 156 of the first insert 150. The popout tabs 114, 116 extending outward from the front face 156 of the first insert 150 are across from and received in an aperture formed by the slots 110' and 112' in the front face 156' of the second insert 150', and the popout tabs 114', 116' extending outward from the front face 156' of the second insert 150' are across from and received in an aperture formed by the slots 110 and 112 in the front face 156 of the first insert 150.

With reference to FIG. 7, the two inserts 150, 150' may be nested together to form a four-pack 250, i.e., each insert 150, 150' comprises two internal receiving areas capable of receiving up to four products (see FIG. 8). Following nesting of the two inserts 150, 150', the inserts 150, 150' may fit snugly together. In particular, the shape and dimensions of the tabs 102, 102', 104, 104', 114, 114', 116, 116' and the respective slots 106, 106', 108, 108', 110, 110', 112, 112' in which they are received may correspond closely, such that the two inserts 150, 150' are held together, at least in part, by a friction fit between the tabs 102, 102', 104, 104', 114, 114', 116, 116' and the respective slots 106, 106', 108, 108', 110, 110', 112, 112'. A junction of the two inserts 150, 150' along their third and fourth faces 160, 160', 162, 162' may be smooth and substantially continuous.

As shown in FIG. 8, two or more inserts 150, 150', 150" may be nested and/or stacked together and placed in an overwrap material or outer package container 300, such as a regular slotted carton, to provide a desired number of internal receiving areas 200-1, 200-1', 200-1", 200-2, 200-2', 200-2" in increments of two, e.g., two, four, six, eight, ten, and so on. Any desired number of products 202 may be shipped, including an odd number, as not every internal receiving area 200-1, 200-1', 200-2, 200-2' must receive a product 202. In one example, two inserts 150, 150' may assembled and nested together to form a four-pack 250, as described herein, to provide four internal receiving areas 200-1, 200-1', 200-2, 200-2' for shipping up to four products 202. One end of each insert, e.g., the second end 166 of the first insert 150 and the first end 164' of the second insert 150' in FIGS. 7 and 8, may be closed as described herein. The product 202 may then be placed in one or both of the internal receiving areas 200-1, 200-1', 200-2, 200-2' of each insert 150, 150', and the other end of each insert, i.e., the first end 164 of the first insert 150 and the second end 166' of the second insert 150', is closed as described herein to enclose the products 202 in the respective internal receiving area(s) 200-1, 200-1', 200-2, 200-2'. Placement of the product 202 and closure of the other end 164, 166' of the inserts 150, 150' may occur prior to or after placement of the four-pack 250 in the carton 300. In addition, the inserts 150, 150' need not be removed from the carton 300 in order to open one of the ends 164, 164', 166, 166' and remove the product 202.

Figure 9:
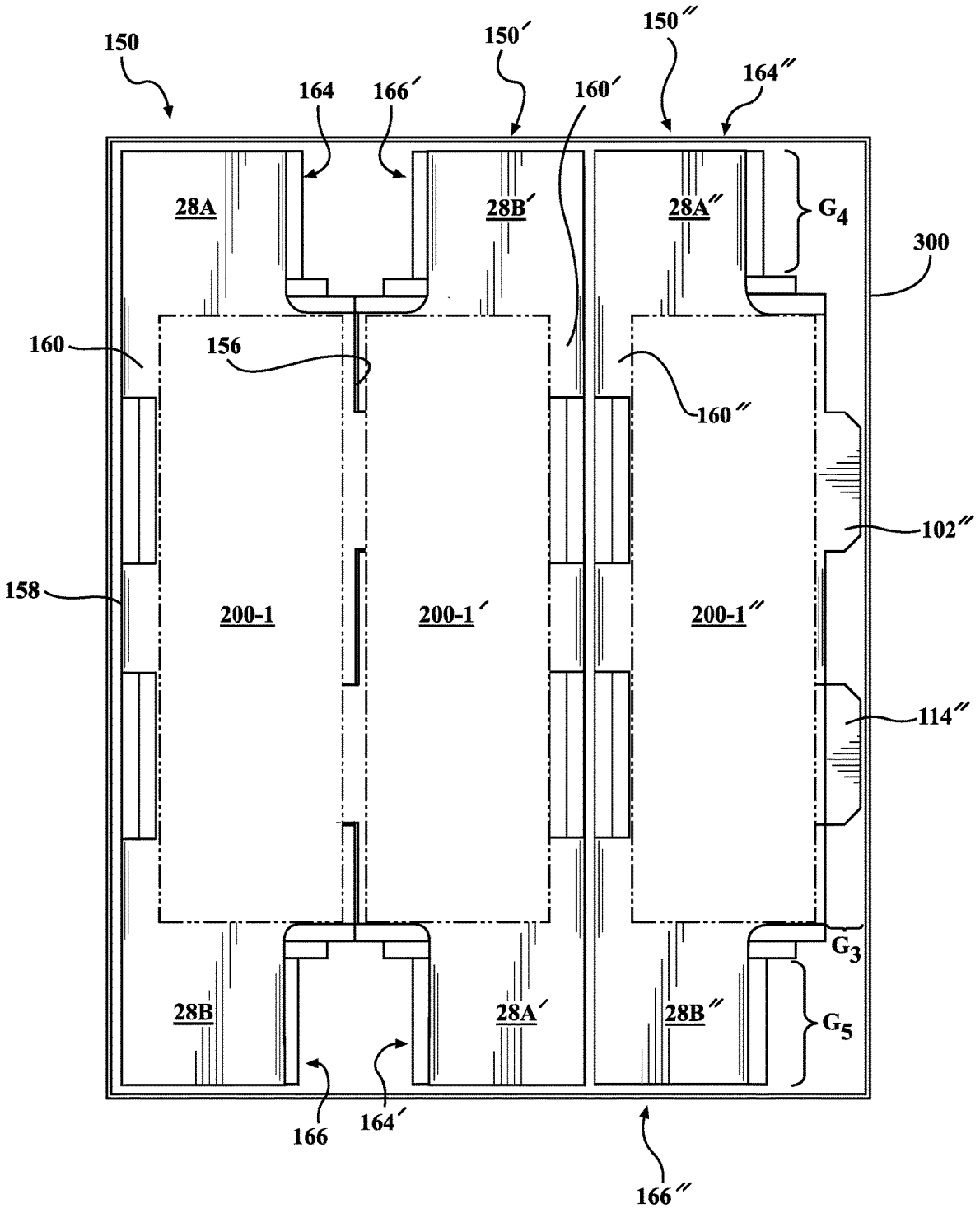
FIG. 9 is a partial cutaway side view of the three inserts in the carton of FIG. 8.

With continued reference to FIG. 8, in another example, three inserts 150, 150', 150" may be nested and stacked together to form a six-pack 252 for shipping up to six products 202, in which two of the inserts 150, 150' are nested together as shown in FIGS. 6 and 7 to form a four-pack 250 and the third insert 150" is stacked with respect to the four-pack 250 such that the back face 158" of the third insert 150" is facing the back face of one of the other inserts, e.g., the back face 158' of the second insert 150', as shown in FIG. 8 (see also FIG. 9). In a further example, an eight-pack (not shown) for shipping up to eight products may be formed by stacking two four-packs 250 such that the back face of one insert in one of the four-packs is facing the back face of one insert in the other four-pack. In all examples, the carton 300 may be cut to the desired size and shape to accommodate the desired number of inserts 150, 150', 150" and to ensure the insert(s) 150, 150', 150" fit snugly within the carton 300, which may allow use of a smaller, lighter weight carton 300. A snug fit between the insert(s) 150, 150', 150" and the carton 300 also prevents unwanted lateral or longitudinal movement of the insert(s) 150, 150', 150" in the carton 300 and helps to maintain the inserts 150, 150', 150" in a nested and/or stacked relationship.

The product 202 may comprise, for example, a bottle or any other type of elongated cylindrical object. In some specific examples, the product 202 may comprise a wine bottle. In other examples, the product 202 may comprise a non-cylindrical object. In some specific examples, one or more pieces of filler material (not shown) may be placed on one or more sides and/or ends of one or more of the internal receiving areas 200-1, 200-1', 200-2, 200-2' to ensure that the product 202 fits snugly within the internal receiving area 200-1, 200-1', 200-2, 200-2' and does not experience excessive lateral and/or longitudinal movement. With reference to FIGS. 8 and 9, it may be seen that when the inserts 150, 150', 150" are placed in the carton 300, each of the internal receiving areas 200-1, 200-1', 200-2, 200-2' is surrounded on all four sides and on each end by two layers of the sheet material comprising the insert 150, 150', 150" and/or by an air gap formed between an outer surface 168, 168', 168" of each of the respective inserts 150, 150', 150" and an adjacent portion of the overwrap material or outer package container 300, e.g., the carton. Thus, when a product 202 is placed in any one of the internal receiving areas 200-1, 200-1', 200-1", 200-2, 200-2', 200-2", the product 202 is protected on all four sides and on both ends, including the side(s) adjacent to other products 202 in the same insert or in an adjacent insert. FIG. 9 is a side view of the third faces 160. 160', 160" of the inserts 150, 150', 150" of FIG. 8, in which the top of the carton 300 has been sealed and a side of the carton 300 facing the viewer has been cut away. The internal receiving areas 200-1. 200-1', 200-1" adjacent to the third faces 160. 160', 160" of the inserts 150, 150', 150" are illustrated in FIG. 9 with dashed lines.

As shown in FIG. 8, the popout tabs extending from the outer surface 168, 168', 168" of each of the respective inserts 150, 150', 150" define an air gap between the carton 300 and the outer surface 168, 168', 168" of each insert 150, 150', 150". For example, the popout tabs 98, 98', 98", 122, 122', 122" extending outward from the respective third faces 160, 160', 160" of the inserts 150, 150', 150" define an air gap $G_1$ between an adjacent portion of the carton 300 and the third faces 160, 160', 160". The popout tabs 100, 100', 100", 124, 124', 124" extending outward from the fourth faces 162, 162', 162" of the inserts 150, 150', 150" define an air gap $G_2$ between an adjacent portion of the carton 300 and the fourth faces 162, 162', 162". Because the first and second inserts 150, 150' are nested together, their respective front faces 156, 156' are facing each other and their respective back faces 158, 158' are facing outward, with the back face 158 of the first insert 150 being adjacent to the carton 300 and the back face 158' of the second insert 150' being adjacent to the back face 158" of the third insert 150". If the third insert 150" were not present, it can be seen that the back face 158' of the second insert 150' would be adjacent to the carton 300. Because the third insert 150" in FIG. 8 is not nested with another insert, the front face 156" of the third insert 150" is facing outward toward the carton 300. The popout tabs 102", 104", 114", 116" extending outward from the first face 156" of the third insert 150" create an air gap $G_3$ between an adjacent portion of the carton 300 and the front face 156" of the third insert 150", as shown in FIGS. 8 and 9. If the third insert 150" were being shipped alone, it can be seen that the back face 158" of the third insert 150" would be adjacent to the carton 300.

As shown in FIG. 9, air gaps $G_4$, $G_5$ are defined between the ends 164, 164', 164", 166, 166', 166" of each insert 150, 150', 150" and adjacent portions of the carton 300. The air gap $G_4$ is defined between the carton 300 and the first end 164 of the first insert 150 (including, for example, the lateral extensions 28A, 32A, 36A, 40A and locking panels 128, 136; see FIGS. 5C and 8); the second end 166' of the second insert 150' (including the lateral extensions 28B, 32B, 36B, 40B and locking panels 132', 140'; see FIGS. 4A, 4B, and 8); and the first end 164" of the third insert 150" (including, for example, the lateral extensions 28A, 32A, 36A, 40A and locking panels 128", 136"; see FIGS. 5C and 8). The air gap $G_5$ is defined between the second end 166 of the first insert 150 (including, for example, the lateral extensions 28B, 32B, 36B, 40B and locking panels 132, 140; see FIGS. 4A and 4B), the first end 164' of the second insert 150' (including, for example, the lateral extensions 28A, 32A, 36A, 40A and locking panels 128, 136; see FIG. 5C), and the second end 166" of the third insert 150" (including, for example, the lateral extensions 28B, 32B, 36B, 40B and locking panels 132, 140; see FIGS. 4A and 4B).

For example, with reference to FIGS. 1, 4A, 4B, 8, and 9, the first internal receiving area 200-1 of the first insert 150 is bordered on a first side by the air gap $G_1$; on a second side by the two layers of material that make up the respective second panels 30, 30' of the first and second inserts 150, 150'; on a third side by the two layers of material that make up the respective third and seventh panels 32, 40 of the first insert 150; on a fourth side by the two layers of material that make up the back face 158 (i.e., the base panel 44 and the fourth panel 34 of the blank 10 of FIG. 1); on one end by the air gap $G_4$; and on the opposing end by the air gap $G_5$. The opposing ends of the first internal receiving area 200-1 are further bordered by the two layers of material that make up respective ones of the end flaps 62, 64, 78, 80.

The second internal receiving area 200-2 of the first insert 150 is bordered on a first side by the air gap $G_2$; on a second side by the two layers of material that make up the respective sixth panels 38, 38' of the first and second inserts 150, 150'; on a third side by the two layers of material that make up the respective third and seventh panels 32, 40 of the first insert 150; on a fourth side by the two layers of material that make up the back face 158 (i.e., the base panel 44 and the eighth panel 42 of the blank 10 of FIG. 1); on one end by the air gap $G_4$; and on the opposing end by the air gap $G_5$. The opposing ends of the second internal receiving area 200-2 are further bordered by the two layers of material that make up respective ones of the end flaps 70, 72, 82, 84.

With continued reference to FIGS. 1, 4A, 4B, 8, and 9, the first internal receiving area 200-1" of the third insert 150" is bordered on a first side by the air gap $G_1$; on a second side by the air gap $G_3$; on a third side by the two layers of material that make up the respective third and seventh panels 32", 40" of the third insert 150"; on a fourth side by the two layers of material that make up the back face 158" (i.e., the base panel 44 and the fourth panel 34 of the blank 10 of FIG. 1); on one end by the air gap $G_4$; and on the opposing end by the air gap $G_5$. The opposing ends of the first internal receiving area 200-1" are further bordered by the two layers of material that make up respective ones of the end flaps 62", 64", 78", 80". When a single insert, e.g., the third insert 150", is shipped in the carton 300, the back face 158" would be adjacent to the carton 300.

The air gaps and/or double layers of sheet material act as shock absorbers to help protect and cushion the products from objects impacting the carton, as well as impacts generated by movement of products in adjacent internal receiving areas. When in their locked position, the locking panels help to ensure that the end flaps remain closed during shipping and may also help to prevent or reduce crushing of the ends of the insert. By surrounding each of the internal receiving areas on all sides and both ends with an air gap and/or two layers of material, inserts in accordance with the present disclosure may reduce damage to the products during transit, particularly for fragile objects such as wine bottles and other glass items. This reduction in damage may result in lowered costs to manufacturers and shippers, as well as customers. Inserts in accordance with the present disclosure may be formed from corrugated board or other recyclable paperboard material(s) and may be assembled, disassembled, and reused repeatedly, including knocking the inserts down flat for transport, disposal, recycling, etc.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An insert formed from a one-piece blank of sheet material, the insert comprising:

a first half comprising a first plurality of panels connected in series at respective fold lines;

a second half connected to the first half and comprising a corresponding, second plurality of panels connected in series at respective fold lines;

a first end comprising lateral extensions extending from first opposing ends of two panels from each of the first and second plurality of panels;

a second end comprising lateral extensions extending from second opposing ends of the two panels from each of the first and second plurality of panels wherein the first and second ends each further comprise a plurality of inner end flaps, a corresponding plurality of outer end flaps, and a plurality of locking panels, wherein each locking panel, when in a locked position, extends over one inner end flap and one corresponding outer end flap; and a plurality of popout tabs extending outward from an outer surface of the insert;

wherein the first half defines a first internal receiving area and the second half defines a second internal receiving area, the first and second internal receiving areas each being surrounded on all sides and on opposing ends by at least one of: (i) two layers of the sheet material, or (ii) an air gap defined between the outer surface of the insert and an adjacent portion of an overwrap material by the popout tabs or the lateral extensions forming the first and second ends.

2. The insert as set forth in claim 1, wherein each of the inner and outer end flaps comprises a cutout extending inward from an outer edge of the respective end flap.

3. The insert as set forth in claim 1, wherein the first and second half of the insert each comprise a respective first end portion, each of the first end portions being defined on a first side by one of the locking panels and on a second and third side by the lateral extensions extending from the first opposing ends of the two panels from either the first or the second plurality of panels, wherein a fourth side of each first end portion comprises an open area, each locking panel forming an entirety of the respective first side that is located opposite the open area.

4. The insert as set forth in claim 3, wherein each locking panel extends toward the respective open area when in the locked position.

5. The insert as set forth in claim 3, wherein the first and second half of the insert each comprise a respective second end portion opposite the respective first end portions, each of the second end portions being defined on a first side by one of the locking panels and on a second and third side by the lateral extensions extending from the second opposing ends of the two panels from either the first or second plurality of panels, wherein a fourth side of each second end portion comprises an open area, each locking panel of the second end portions forming an entirety of the respective first side that is located opposite the open area.

6. The insert as set forth in claim 5, wherein each locking panel in the second end portions extends toward the respective open area when in the locked position.

7. The insert as set forth in claim 5, wherein the opposing ends of the first internal receiving area are defined by one of the first end portions and one of the second end portions and the opposing ends of the second internal receiving area are defined by the other of the first end portions and the other of second end portions.

8. The insert as set forth in claim 1, wherein:

the first plurality of panels comprises a first, second, third, and fourth panel; and the second plurality of panels comprises a fifth, sixth, seventh, and eighth panel;

the insert further comprising:

a base panel connected to the first panel along a first side at a first fold line and to the fifth panel along a second side at a second fold line.

9. The insert as set forth in claim 8, wherein:

the plurality of inner end flaps comprises a first pair of inner end flaps foldably joined to laterally opposed ends of the fourth panel and a second pair of inner end flaps foldably joined to laterally opposed ends of the eighth panel;

the plurality of outer end flaps comprises first and second pairs of outer end flaps foldably joined to laterally opposed ends of the base panel;

the first end comprises one end flap from each of the first and second pairs of inner and outer end flaps; and the second end comprises the other end flap from each of the first and second pairs of inner and outer end flaps.

10. The insert as set forth in claim 9, wherein:

the first end comprises two first end portions, one first end portion comprising one end flap from each of the first pair of inner and outer end flaps and the other first end portion comprising one end flap from each of the second pair of inner and outer end flaps, wherein each of the first end portions comprises one of the plurality of locking panels; and the second end comprises two second end portions, one second end portion comprising the other end flap from each of the first pair of inner and outer end flaps and the other second end portion comprising the other end flap from each of the second pair of inner and outer end flaps, wherein each of the second end portions comprises one of the plurality of locking panels.

11. The insert as set forth in claim 10, wherein when the first and second end portions are closed, each outer end flap is folded over the respective inner end flap and the locking panel is in the locked position extending over the respective outer and inner end flaps.

12. The insert as set forth in claim 8, wherein:

the second and sixth panels together form a first face of the insert;

the base panel and the fourth and eighth panels together form a second face of the insert, the base panel being parallel to the fourth and eighth panels;

the first panel forms a third face of the insert; and the fifth panel forms a fourth face of the insert.

13. The insert as set forth in claim 12, wherein the insert is configured to be nested with a second insert that is rotated 180o, the first face of the insert being in a facing relationship with a corresponding first face of the second insert when nested with the second insert.

14. The insert as set forth in claim 13, wherein:

the first face of the insert comprises at least one slot and a portion of the plurality of popout tabs, wherein the popout tabs extend outward from the first face of the insert; and the corresponding first face of the second insert comprises at least one corresponding slot to receive the plurality of popout tabs extending outward from the first face of the insert and a corresponding plurality of popout tabs that are received in the at least one slot.

15. The insert as set forth in claim 8, wherein the first, third, and fourth faces of the insert each comprise a plurality of popout tabs extending outward therefrom.

16. A one-piece blank of sheet material for forming a shipping insert, the blank comprising:

a first section comprising first, second, third, and fourth panels connected in series at respective fold lines, wherein first and second opposing outer ends of the first and third panels each comprise lateral extensions;

a second section comprising fifth, sixth, seventh, and eighth panels connected in series at respective fold lines, wherein first and second opposing outer ends of the fifth and seventh panels each comprise lateral extensions;

a base panel connected to the first panel along a first side at a first fold line and to the fifth panel along a second side at a second fold line; and a plurality of locking panels defined in a lateral direction between an elongated slot and a respective lateral edge of the one-piece blank, wherein the locking panels and corresponding elongated slots extend in a longitudinal direction between the lateral extensions on the first or the second opposing ends of the first and third panels or the fifth and seventh panels.

17. The one-piece blank as set forth in claim 16, wherein:

the fourth panel comprises a pair of end flaps foldably joined to laterally opposed ends thereof;

the eighth panel comprises a pair of end flaps foldably joined to laterally opposed ends thereof; and the base panel comprises a first and a second pair of end flaps foldably joined to laterally opposed ends thereof.

18. The one-piece blank as set forth in claim 16, wherein the first, third, fourth, fifth, seventh, eighth, and base panels each comprise at least one popout tab extending outward therefrom in the longitudinal direction.

* * * * *